US009707141B2

(12) United States Patent
Bobey et al.

(10) Patent No.: US 9,707,141 B2
(45) Date of Patent: Jul. 18, 2017

(54) PATIENT SUPPORT

(75) Inventors: John A. Bobey, Daniel Island, SC (US); Gregory W. Branson, Batesville, IN (US); Rebecca A. Ginther, Harrison, OH (US); Reza Hakamiun, Charleston, SC (US); Charles Lachenbruch, Summerville, SC (US); Jonathan H. Mueller, Mt. Pleasant, SC (US); Sohrab Soltani, Charleston, SC (US); Bradley T. Wilson, Batesville, IN (US); Stephen L. Douglas, Batesville, IN (US); Kenith W. Chambers, Batesville, IN (US); Rachel H. King, Lawrenceburg, IN (US); Eric R. Meyer, Greensburg, IN (US); Christopher R. O'Keefe, Batesville, IN (US); Richard B. Stacy, Daniel Island, SC (US); Thomas Uzzle, Mt. Pleasant, SC (US)

(73) Assignee: Hill-Rom Services, Inc., Batesville, IN (US)

( * ) Notice: Subject to any disclaimer, the term of this patent is extended or adjusted under 35 U.S.C. 154(b) by 1765 days.

(21) Appl. No.: 11/994,777

(22) PCT Filed: Jul. 7, 2006

(86) PCT No.: PCT/US2006/026620
§ 371 (c)(1),
(2), (4) Date: Sep. 5, 2008

(87) PCT Pub. No.: WO2007/008723
PCT Pub. Date: Jan. 18, 2007

(65) Prior Publication Data

US 2009/0217460 A1 Sep. 3, 2009

Related U.S. Application Data

(60) Provisional application No. 60/697,723, filed on Jul. 5, 2005.

(51) Int. Cl.
*A61G 7/00* (2006.01)
*A61G 7/057* (2006.01)

(52) U.S. Cl.
CPC ..... *A61G 7/00* (2013.01); *A61G 7/05769* (2013.01); *A61G 7/05784* (2016.11);
(Continued)

(58) Field of Classification Search
CPC ..... A61G 7/00
(Continued)

(56) References Cited

U.S. PATENT DOCUMENTS 779,576 A 1/1905 Berryman
800,967 A 10/1905 Young et al.
(Continued)

FOREIGN PATENT DOCUMENTS

CA 2 393 880 A1 1/2004
DE 29502025 7/1996
(Continued)

OTHER PUBLICATIONS

Supplementary European search report from EP 06 78 6689 dated Oct. 26, 2011, 5 pages.
(Continued)

*Primary Examiner* — Fredrick Conley
(74) *Attorney, Agent, or Firm* — Barnes & Thomburg LLP

(57) ABSTRACT

This disclosure describes certain exemplary embodiments of a patient support having a plurality of vertically-oriented on substantially can-shaped inflatable bladders. In one embodiment, the patient support includes a support layer positioned above the vertical bladders. In another embodiment, the patient support includes a high air loss device. In still
(Continued)

another embodiment, the patient support includes a pneumatic device located within the patient support.

24 Claims, 20 Drawing Sheets

(52) U.S. Cl.
CPC ..... *A61G 7/001* (2013.01); *A61G 2200/16* (2013.01); *A61G 2203/34* (2013.01); *A61G 2203/42* (2013.01)

(58) Field of Classification Search
USPC ..... 5/709, 706, 714, 716, 713
See application file for complete search history.

(56) References Cited

U.S. PATENT DOCUMENTS 1,121,277 A 12/1914 Mitchell
1,332,933 A 3/1920 Sylvester
1,772,310 A 8/1930 Hart
3,303,518 A 2/1967 Ingram
3,492,988 A 2/1970 DeMare
3,772,717 A 11/1973 Yuen et al.
3,978,530 A 9/1976 Amarantos
4,114,620 A 9/1978 Moore et al.
4,347,633 A 9/1982 Gammons et al.
4,448,228 A 5/1984 Hashimoto et al.
4,477,935 A 10/1984 Griffin
4,483,029 A 11/1984 Paul
4,525,885 A 7/1985 Hunt et al.
4,527,298 A 7/1985 Moulton
4,541,135 A 9/1985 Karpov
4,542,547 A 9/1985 Sato
4,637,083 A 1/1987 Goodwin
4,638,519 A 1/1987 Hess
4,689,844 A 9/1987 Alivizatos
4,694,521 A 9/1987 Tominaga
4,797,962 A 1/1989 Goode
4,825,486 A 5/1989 Kimura et al.
4,837,877 A 6/1989 Hamada et al.
4,839,512 A 6/1989 Speck
4,884,304 A 12/1989 Elkins
4,907,308 A 3/1990 Leininger et al.
4,934,468 A 6/1990 Koerber, Sr. et al.
4,944,060 A 7/1990 Peery et al.
4,951,335 A 8/1990 Eady
4,953,244 A 9/1990 Koerger, Sr. et al.
4,993,920 A 2/1991 Harkleroad et al.
5,020,176 A 6/1991 Dotson
5,029,352 A 7/1991 Hargest et al.
5,036,559 A 8/1991 Hargest
5,060,174 A 10/1991 Gross
5,067,189 A 11/1991 Weedling et al.
5,117,518 A 6/1992 Schild
5,121,512 A 6/1992 Kaufmann
5,140,309 A 8/1992 Gusakov
5,163,196 A 11/1992 Graebe et al.
5,168,589 A 12/1992 Stroh et al.
5,180,619 A 1/1993 Landi et al.
5,184,122 A 2/1993 Decious et al.
5,267,364 A 12/1993 Volk
5,269,030 A 12/1993 Pahno et al.
5,276,432 A 1/1994 Travis
5,289,030 A 2/1994 Yamazaki et al.
5,316,041 A 5/1994 Ramacier, Jr. et al.
5,325,551 A 7/1994 Tappel et al.
5,350,417 A 9/1994 Augustine
5,364,162 A 11/1994 Bar et al.
5,373,595 A 12/1994 Hogan
5,402,542 A 4/1995 Viard
5,444,881 A 8/1995 Landi et al.
5,448,788 A 9/1995 Wu
5,483,709 A 1/1996 Foster et al.
5,483,711 A 1/1996 Hargest et al.
5,539,942 A 7/1996 Melou
5,542,136 A 8/1996 Tappel
5,561,873 A 10/1996 Weedling
5,561,875 A 10/1996 Graebe
5,564,142 A 10/1996 Liu
5,586,346 A 12/1996 Stacy et al.
5,596,781 A 1/1997 Graebe
5,611,096 A 3/1997 Bartlett et al.
5,623,736 A 4/1997 Soltani et al.
5,630,238 A * 5/1997 Weismiller ..... A61G 7/018 5/600
5,634,225 A 6/1997 Miller, Sr. et al.
D386,035 S 11/1997 Matsler et al.
5,689,845 A 11/1997 Sobieralski
5,692,256 A 12/1997 Kramer et al.
5,699,570 A 12/1997 Wilkinson et al.
5,715,548 A 2/1998 Weismiller et al.
5,731,062 A 3/1998 Kim et al.
5,755,000 A 5/1998 Thompson
5,785,716 A 7/1998 Bayron et al.
5,787,531 A 8/1998 Pepe
5,794,288 A 8/1998 Soltani et al.
5,815,864 A 10/1998 Sloop
5,815,865 A 10/1998 Washburn et al.
5,829,081 A 11/1998 Pearce
5,840,400 A 11/1998 Landi et al.
5,845,352 A 12/1998 Matsler et al.
5,873,137 A 2/1999 Yavets-Chen
D407,353 S 3/1999 Bar et al.
D408,767 S 4/1999 Bar et al.
5,917,180 A 6/1999 Reimer et al.
5,926,884 A 7/1999 Biggie et al.
D412,685 S 8/1999 Bar et al.
D413,085 S 8/1999 Bar et al.
5,934,280 A 8/1999 Viard et al.
D413,841 S 9/1999 Bar et al.
5,954,402 A 9/1999 McInturff
D415,567 S 10/1999 Bar
D415,834 S 10/1999 Bar
5,966,762 A 10/1999 Wu
5,966,763 A 10/1999 Thomas et al.
5,970,789 A 10/1999 Meyer et al.
D416,326 S 11/1999 Bar
5,984,418 A 11/1999 McInturff
5,989,285 A 11/1999 De Vilbiss et al.
5,991,949 A 11/1999 Miller, Sr. et al.
6,014,346 A 1/2000 Malone
6,021,533 A * 2/2000 Ellis ..... A61G 7/0507 5/425
6,036,660 A 3/2000 Toms
6,049,927 A 4/2000 Thomas et al.
6,073,289 A 6/2000 Bolden et al.
6,076,208 A 6/2000 Heimbrock et al.
6,095,611 A 8/2000 Bar et al.
6,145,142 A 11/2000 Rechin et al.
6,154,907 A 12/2000 Cinquin
6,165,142 A 12/2000 Bar
6,175,752 B1 1/2001 Say et al.
6,182,316 B1 2/2001 Thomas et al.
D439,098 S 3/2001 Matsler et al.
6,212,718 B1 * 4/2001 Stolpmann ..... A61G 7/05776 285/914
6,223,369 B1 * 5/2001 Maier ..... A61G 7/05707 5/706
6,240,584 B1 6/2001 Perez et al.
6,272,707 B1 8/2001 Robrecht et al.
6,320,510 B2 11/2001 Menkedick et al.
6,367,106 B1 * 4/2002 Gronsman ..... A47C 4/54 5/655.3
6,378,152 B1 4/2002 Washburn et al.
6,401,283 B2 6/2002 Thomas et al.
D463,701 S 10/2002 Gorcherding et al.
6,474,743 B1 11/2002 Harker et al.
6,487,739 B1 12/2002 Harker
6,499,167 B1 12/2002 Ellis et al.
6,560,804 B2 5/2003 Wise et al.
6,564,410 B2 5/2003 Graebe et al.
6,568,273 B2 5/2003 Reimer
6,582,456 B1 6/2003 Hand et al.

(56) References Cited

U.S. PATENT DOCUMENTS

| | | | | |
|---|---|---|---|---|
| 6,593,588 | B1 | 7/2003 | Reimer | |
| 6,623,080 | B2 | 9/2003 | Clapper | |
| 6,646,556 | B1 | 11/2003 | Smith et al. | |
| 6,687,936 | B2 | 2/2004 | Graebe et al. | |
| 6,687,937 | B2 | 2/2004 | Harker | |
| 6,701,556 | B2 | 3/2004 | Romano et al. | |
| 6,721,979 | B1 | 4/2004 | Vrzalik et al. | |
| 6,730,115 | B1 | 5/2004 | Heaton | |
| 6,735,799 | B1 | 5/2004 | Ellis et al. | |
| 6,735,801 | B2 | 5/2004 | Henley et al. | |
| 6,760,939 | B2 | 7/2004 | Ellis et al. | |
| 6,782,574 | B2 * | 8/2004 | Totton et al. | 5/713 |
| 6,848,135 | B1 | 2/2005 | Kohlman | |
| 6,877,178 | B2 | 4/2005 | Chapman et al. | |
| 7,698,765 | B2 * | 4/2010 | Bobey et al. | 5/713 |
| 2001/0011480 | A1 | 8/2001 | Reimer | |
| 2002/0066143 | A1 | 6/2002 | Graebe et al. | |
| 2002/0104345 | A1 * | 8/2002 | Wang | E05B 13/101 70/472 |
| 2003/0030319 | A1 | 2/2003 | Clapper | |
| 2003/0110568 | A1 | 6/2003 | Stolpmann | |
| 2004/0237203 | A1 * | 12/2004 | Romano | A47C 27/122 5/713 |
| 2005/0011009 | A1 * | 1/2005 | Wu | 5/726 |
| 2006/0075559 | A1 * | 4/2006 | Skinner et al. | 5/615 |
| 2006/0112489 | A1 * | 6/2006 | Bobey et al. | 5/655.3 |
| 2007/0050910 | A1 * | 3/2007 | Blanchard et al. | 5/617 |
| 2007/0235036 | A1 * | 10/2007 | Bobey et al. | 128/845 |

FOREIGN PATENT DOCUMENTS

| | | | |
|---|---|---|---|
| DE | 103 16 162 | A1 | 10/2004 |
| DE | 103 33 742 | A1 | 2/2005 |
| EP | 0 579 381 | A2 | 1/1994 |
| EP | 853 918 | A2 | 7/1998 |
| FR | 2 596 950 | | 10/1987 |
| FR | 2 814 062 | | 3/2002 |
| GB | 159299 | | 2/1921 |
| GB | 2 092 439 | A | 8/1982 |
| GB | 2 167 293 | A | 5/1986 |
| GB | 2 199 803 | A | 7/1988 |
| GB | 2 212 058 | A | 7/1989 |
| JP | 2007-159981 | | 6/2007 |
| WO | WO 94/09686 | | 5/1984 |
| WO | WO 95/31920 | | 11/1995 |
| WO | WO 96/33641 | | 10/1996 |
| WO | WO 9956591 | A1 * | 11/1999 |
| WO | WO 03/041538 | | 5/2003 |
| WO | WO 2004/006768 | | 1/2004 |
| WO | WO 2005/013878 | | 2/2005 |

OTHER PUBLICATIONS

Roho Dry Flotation Isolette see roho.com/medical/isolette.jsp., date unknown.

ROHO series Crown Therapeutic, Inc., see woundheal.com, date unknown.

TYTEX Group AirX #D Spacer Fabric see tytex.cms. digitalis.dk, dte unknown.

Renaissance™ Therapeutic Mattress Replacement System, Pegasus Airwave, Inc., date unknown.

Air Flow 5000 Mattress Replacement System, Atlantis Medical, Milltown, NJ, date unknown.

Apropros, CRS-8500, National Patient Care Systems, date unknown.

ASAP II Therapy System, DynaMedics Corporation, London, ON, Canada Mar. 1995.

Bazooka, Innovative Medical System, Manchester, NH, 1995.

DFS® Homecare Advanced Dynamic Flotation System, HNE Healthcare, Manalapan, NJ, date unknown.

A Hill-Rom Solution, Acucair Continuous Airflow System, Hill-Rom Company, Inc., Batesville, IN, 1998.

Hill-Rom PrimeAire® ARS Pressure Relief Mattress, Hill-Rom Company, Inc., Batesville, IN, 2004.

Gaymar Soft-Care Plus© Companion System, Gaymar Industries, Inc., 1994.

First Step, Mattress Replacement System, KCI, San Antonio, TX, 1991.

Impression Pressure Relief Therapy, KCI, date unknown.

Lumex Akro Tech 4000, Lumex, date unknown.

MicroAIRO 1000, GSI Medical Systems, Carmel, NY, 1989.

PRO 2000 MRS, Pneu-Care Series, Cardio Systems, Dallas, TX, date unknown.

Prodigy Mattress Crown Therapeutics, Inc., date unknown.

Economic Relief, Bio Therapy © Plus, Sunrise Medical Bio Clinic, Ontario, CA, date unknown.

International Search Report and Written Opinion for PCT/US06/26787, dated Mar. 6, 2008 (8 pages).

International Search Report and Written Opinion for PCT/US06/026788, dated Aug. 13, 2007 (10 pages).

International Search Report and Written Opinion for PCT/US2006/026620 filed Jul. 7, 2006 (Jul. 7, 2006).

* cited by examiner

PATIENT SUPPORT

CROSS-REFERENCE TO RELATED APPLICATIONS

This application is the U.S. national phase of PCT/US2006/026620 filed Jul. 7, 2006. PCT/US2006/026620 claims priority to U.S. Provisional Patent Application No. 60/697,723 filed Jul. 8, 2005, entitled PRESSURE CONTROL FOR A HOSPITAL BED. The entire disclosures of both PCT/US2006/026620 and U.S. Ser. No. 60/697,723 are hereby incorporated by reference. The present application is related to U.S. patent application Ser. No. 11/119,980, entitled PRESSURE RELIEF SURFACE, and U.S. patent application Ser. No. 11/119,991, entitled PATIENT SUPPORT HAVING REAL TIME PRESSURE CONTROL, and U.S. patent application Ser. No. 11/119,635, entitled LACK OF PATIENT MOVEMENT MONITOR AND METHOD, and U.S. patent application Ser. No. 11/120,080, entitled PATIENT SUPPORT, all of which were filed on May 2, 2005, all of which are assigned to the assignee of the present invention, and all of which are incorporated herein by this reference.

PCT/US2006/026620 is also related to U.S. Provisional Patent Application Ser. No. 60/636,252, entitled QUICK CONNECTOR FOR MULTIMEDIA, filed Dec. 15, 2004, which is assigned to the assignee of the present invention and incorporated herein by this reference.

PCT/US2006/026620 is also related to U.S. Provisional Patent Application Ser. No. 60/697,748, entitled PRESSURE CONTROL FOR A HOSPITAL BED, and corresponding PCT application No. PCT/US2006/026787, and U.S. Provisional Patent Application Ser. No. 60/697,708, entitled CONTROL UNIT FOR A PATIENT SUPPORT, and corresponding PCT Application No. PCT/US2006/026788, all of which are incorporated herein by this reference.

BACKGROUND OF THE DISCLOSURE

The present invention relates to a device for supporting a patient, such as a mattress. In particular, the present invention relates to patient supports appropriate for use in hospitals, acute care facilities, and other patient care environments. Further, the present invention relates to pressure relief support surfaces and support surfaces that are configured to accommodate and operate with a variety of sizes and styles of beds, bed frames, and patient types.

Known patient supports are disclosed in, for example, U.S. Pat. No. 5,630,238 to Weismiller et al., U.S. Pat. No. 5,715,548 to Weismiller et al., U.S. Pat. No. 6,076,208 to Heimbrock et al., U.S. Pat. No. 6,240,584 to Perez et al., U.S. Pat. No. 6,320,510 to Menkedick et al., U.S. Pat. No. 6,378,152 to Washburn et al., and U.S. Pat. No. 6,499,167 to Ellis et al., all of which are owned by the assignee of the present invention and all of which are incorporated herein by this reference.

SUMMARY OF THE DISCLOSURE

According to one embodiment of the present invention, a patient support comprises a cover, a body located within the cover, and a high air loss device. The body includes a plurality of bladders. The high air loss device includes a supply tube and a delivery tube. The supply tube receives a volume of low pressure air from an air supply. The delivery tube includes a plurality of apertures configured to vent the air received from the supply tube around the bladders.

According to another embodiment of the present invention, a patient support comprises a cover, a body and a high air loss device. The cover includes a head end, a foot end, and a pair of sides. The body is located within the cover and includes a plurality of bladders. The high air loss device includes an enclosure positioned above the bladders and a supply tube. The supply tube receives a volume of low pressure air from an air supply and the air moves through the enclosure.

According to another embodiment of the present invention, a patient support comprises a cover, a body, a plurality of bladders, at least one sensor, and a pneumatic device. The cover includes an upper portion and a lower portion. The upper portion and the lower portion define an interior region. The body is located within the interior region. The body includes a head section, a seat section, and a foot section. The bladders are located within the interior region. At least one sensor is located within the interior region. The pneumatic device is located within the interior region. The pneumatic device includes at least one valve block and at least one control board that is configured to receive a signal from the at least one sensor.

According to yet another embodiment of the present invention, a patient support is provided to move between a use position and a folded position. The patient support comprises a cover, a plurality of bladders, a control unit, and at least one strap. The cover includes an upper cover and a lower cover, the upper cover and lower cover define an interior region. The plurality of bladders is located within the interior region. The control unit is operably coupled to the plurality of bladders. The control unit includes an air pump and a switching valve. The control unit is selectively configurable to provide a positive pressure to fill the plurality of bladders and a negative pressure to evacuate the plurality of bladders. The at least one strap holds the patient support in the folded position.

According to yet another embodiment of the present invention, a patient support comprises a cover, a body, a plurality of support bladders, at least one turn assist bladder, a first switch, and a controller. The cover includes an upper cover and a lower cover. The upper cover and lower cover define an interior region. The body is located within the interior region and includes a head section, a seat section, and a foot section. The plurality of support bladders is located within the interior region. The at least one turn assist bladder is located below the plurality of support bladders. The first switch is located within the interior region and is configured to actuate when the head section is raised to at least a first angle relative to the seat section. The controller is coupled to the first switch and the at least one turn assist bladder is configured to receive an indication that the first switch was actuated and control actuation of the at least one turn assist bladder.

According to yet another embodiment of the present invention, a patient support comprises a cover, a body, and an air loss device. The body is located within the cover and includes a bladder. The air loss device includes a tube. The tube includes a plurality of apertures and receives a volume of air from an air supply. The plurality of apertures is configured to deliver the air received across the bladder.

Additional features and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

Aspects of the present invention are more particularly described below with reference to the following figures, which illustrate exemplary embodiments of the present invention.

DETAILED DESCRIPTION OF ILLUSTRATED EMBODIMENTS

Figure 1:
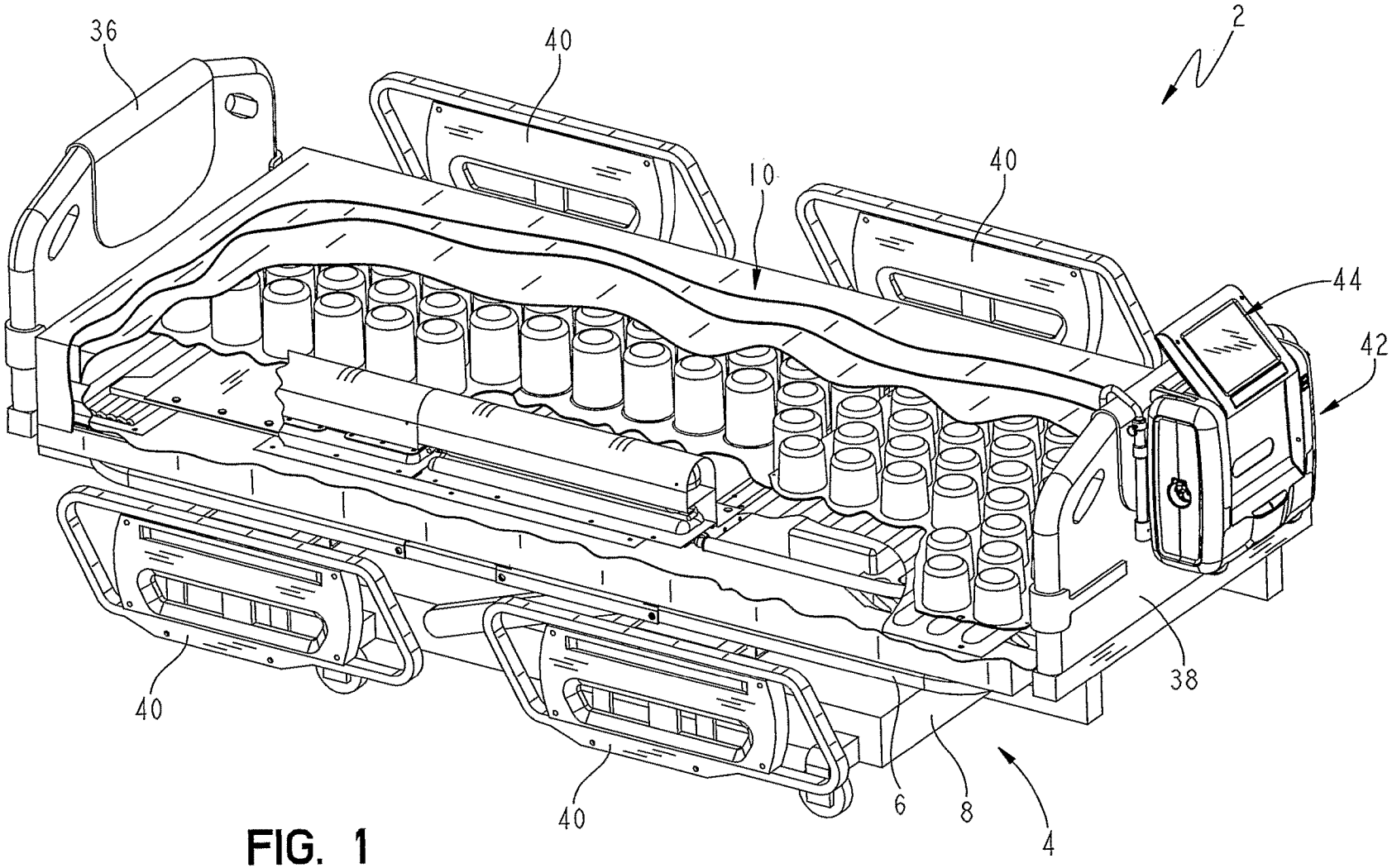
FIG. 1 is a perspective view of a patient support positioned on an exemplary hospital bed, with a portion of the patient support being cut away to show interior components of the patient support.

FIG. 1 shows an embodiment of a patient support or mattress 10 in accordance with the present invention. Patient support 10 is positioned on an exemplary bed 2. Bed 2, as illustrated, is a hospital bed including a frame 4, a headboard 36, a footboard 38, and a plurality of siderails 40.

Frame 4 of the exemplary bed 2 generally includes a deck 6 supported by a base 8. Deck 6 includes one or more deck sections (not shown), some or all of which maybe articulating sections, i.e., pivotable with respect to base 8. In general, patient support 10 is configured to be supported by deck 6.

Patient support 10 has an associated control unit 42, which controls inflation and deflation of certain internal components of patient support 10, among other things. Control unit 42 includes a user interface 44, which enables caregivers, service technicians, and/or service providers to configure patient support 10 according to the needs of a particular patient. For example, support characteristics of patient support 10 may be adjusted according to the size, weight, position, or activity of the patient. Patient support 10 can accommodate a patient of any size, weight, height or width. It is also within the scope of the present invention to accommodate bariatric patients of up to 1000 pounds or more. To accommodate patients of varied sizes, the patient support may include a width of up to 50 inches or more. User interface 44 is password-protected or otherwise designed to prevent access by unauthorized persons.

User Interface 44 also enables patient support 10 to be adapted to different bed configurations. For example, deck 6 may be a flat deck or a step or recessed deck. A caregiver may select the appropriate deck configuration via user interface 44. An exemplary control unit 42 and user interface 44 are described in detail in U.S. Provisional Patent Application Ser. No. 60/687,708, filed Jul. 8, 2005, and corresponding PCT Application No. PCT/US2006/026788 assigned to the assignee of the present invention, and incorporated herein by reference.

Figure 2:
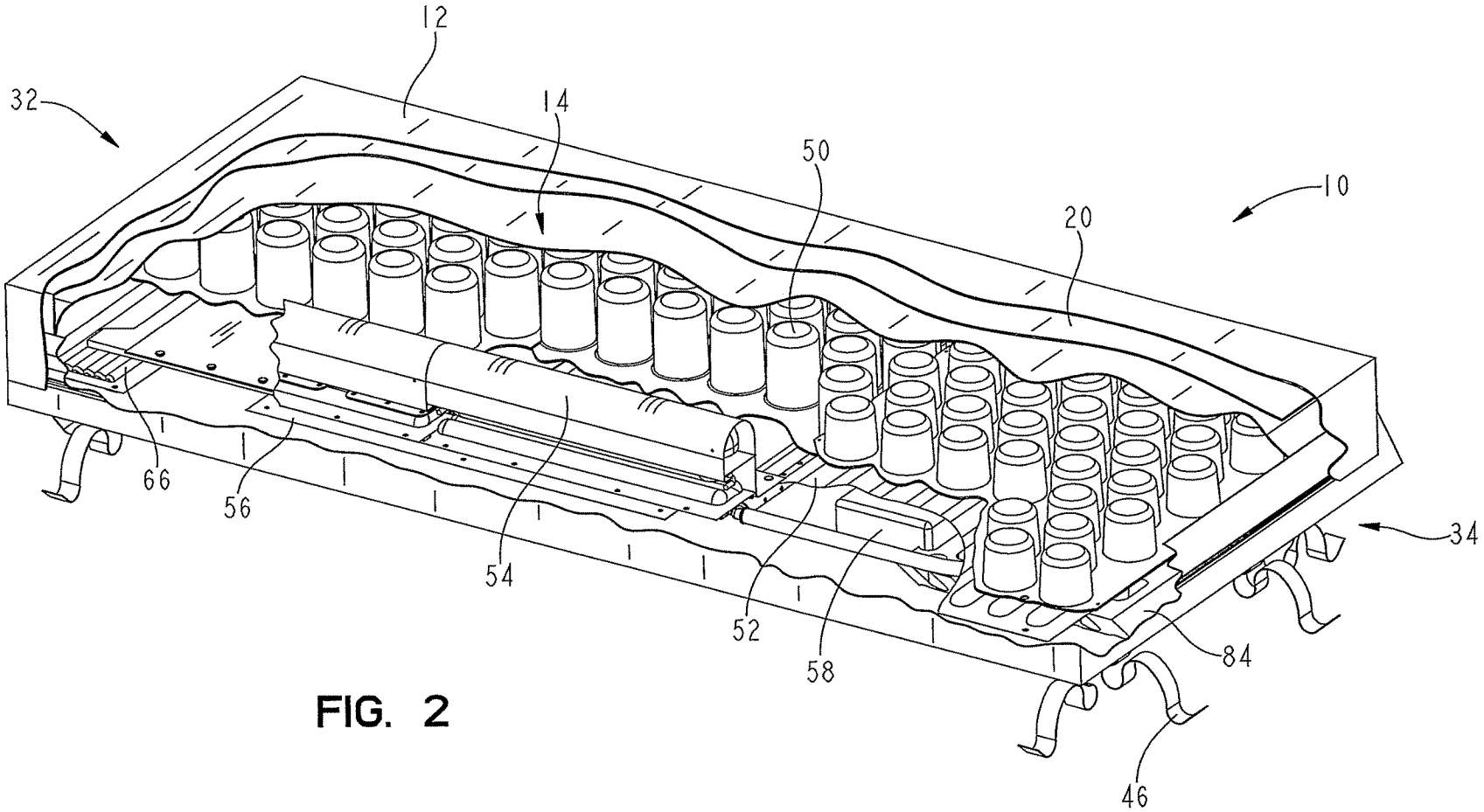
FIG. 2 is a perspective view of a patient support, with a portion being cut away to show interior components of the patient support.

Referring now to FIG. 2, patient support 10 has a head end 32 generally configured to support a patient's head and/or upper body region, and a foot end 34 generally configured to support a patient's feet and/or lower body region. Patient support 10 includes a cover 12 which defines an interior region 14. In the illustrated embodiment, interior region 14 includes a first layer 20, a second layer 50, and a third layer 52. However, it will be understood by those skilled in the art that other embodiments of the present invention may not include all three of these layers, or may include additional layers, without departing from the scope of the present invention.

In the illustrated embodiment, first layer 20 includes a support material, second layer 50 includes a plurality of vertically-oriented inflatable bladders located underneath the first layer 20, and third layer 52 includes a plurality of pressure sensors located underneath the vertical bladders of second layer 50, as more particularly described below.

Also located within interior region 14 are a plurality of bolsters 54, one or more filler portions 56, and a pneumatic valve control box, valve box, control box, or pneumatic box 58. A fire-resistant material (not shown) may also be included in the interior region 14.

Patient support 10 maybe coupled to deck 6 by one or more couplers 46. Illustratively, couplers 46 are conventional woven or knit or fabric straps including a D-ring or hook and loop assembly or Velcro®-brand strip or similar fastener. It will be understood by those skilled in the art that other suitable couplers, such as buttons, snaps, or tethers may also be used equally as well.

Figure 3:
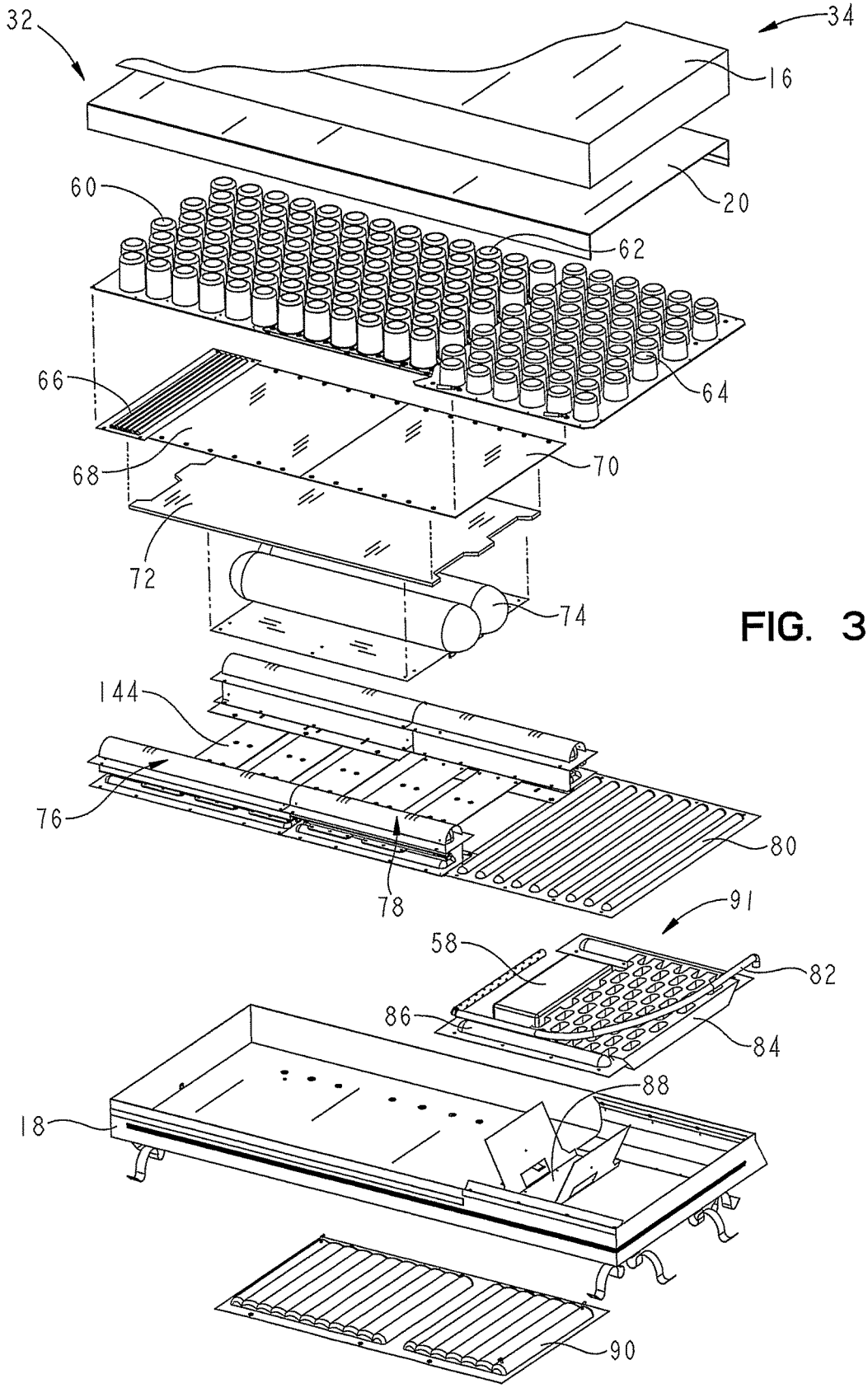
FIG. 3 is an exploded view of components of the illustrated embodiment of a patient support.

Components of one embodiment of a patient support in accordance with the present invention are shown in exploded view in FIG. 3. This embodiment of patient support 10 includes a top cover portion 16 and a bottom cover portion 18. Top cover portion 16 and bottom cover portion 18 couple together by conventional means (such as zipper, Velcro® strips, snaps, buttons, or other suitable fastener) to form cover 12, which defines interior region 14. While a plurality of layers and/or components are illustrated within interior region 14, it will be understood by those of skill in the art that the present invention does not necessarily require all of the illustrated components to be present.

Figure 4:
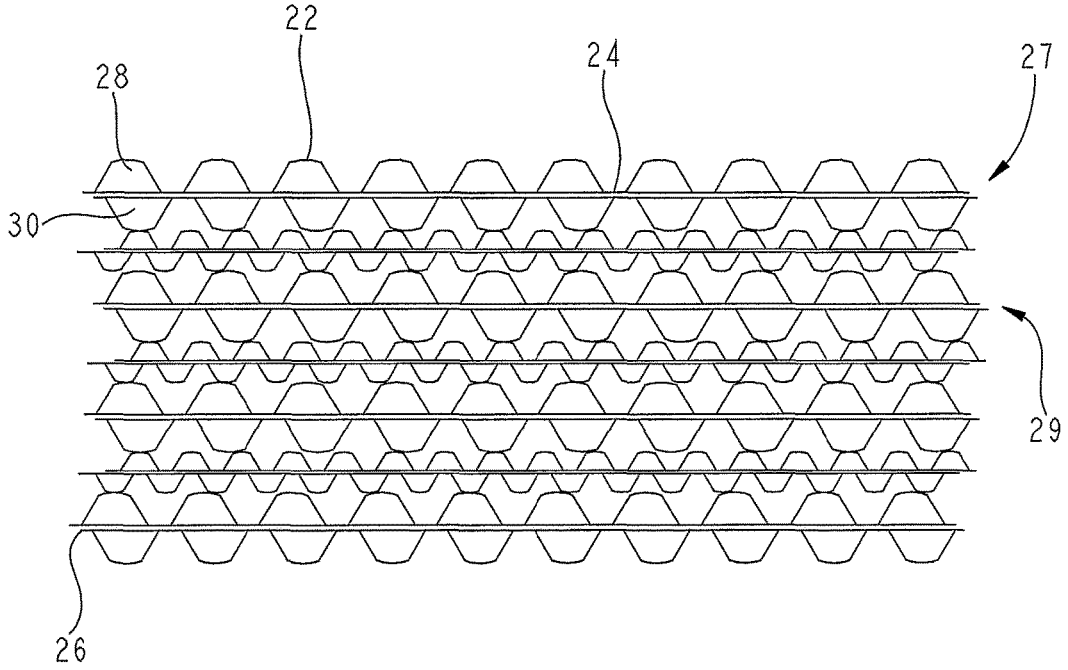
FIG. 4 is a schematic view of an exemplary three-dimensional support material.

A first support layer 20 is located below top cover portion 16 in interior region 14. First support layer 20 includes one or more materials, structures, or fabrics suitable for supporting a patient, such as foam, inflatable bladders, or three-dimensional material. Suitable three-dimensional materials include Spacenet, Tytex, and/or similar materials. One embodiment of a suitable three dimensional material for support layer 20 is shown in FIG. 4, described below.

Returning to FIG. 3, a second support layer 50 including one or more inflatable bladder assemblies, is located underneath the first support layer 20. The illustrated embodiment of the second support layer 50 includes first, second and third bladder assemblies, namely, a head section bladder assembly 60, a seat section bladder assembly 62, and a foot section bladder assembly 64. However, it will be understood by those skilled in the art that other embodiments include only one bladder assembly extending from head end 32 to foot end 34, or other arrangements of multiple bladder assemblies, for example, including an additional thigh section bladder assembly. The illustrated bladder assemblies 60, 62, 64 and their components are described below with reference to FIGS. 5-19. In general, bladder assemblies disclosed herein are formed from a lightweight, flexible air-impermeable material such as a polymeric material like polyurethane, urethane-coated fabric, vinyl, or rubber.

A pressure-sensing layer 69 illustratively including first and second sensor pads, namely a head sensor pad 68 and a seat sensor pad 70, is positioned underneath bladder assemblies 60, 62, 64. Head sensor pad 68 is generally aligned underneath head section bladder assembly 60, and seat sensor pad 70 is generally aligned underneath seat section bladder assembly 62, as shown. Head filler 66 maybe positioned adjacent head sensor pad 68 near head end 32 so as to properly position head sensor pad 68 underneath the region of patient support 10 most likely to support the head or upper body section of the patient. In other embodiments, a single sensor pad or additional sensor pads, for example, located underneath foot section bladder assembly 64, and/or different alignments of the sensor pads, are provided. Sensor pads 68, 70 are described below with reference to FIGS. 20-21.

In the illustrated embodiment, a turn-assist cushion or turning bladder or rotational bladder 74 is located below sensor pads 68, 70. The exemplary turn-assist cushion 74 shown in FIG. 3 includes a pair of inflatable bladders 74*a*, 74*b*. Another suitable rotational bladder 74 is a bellows-shaped bladder. Another suitable turn-assist cushion is disclosed in, for example, U.S. Pat. No. 6,499,167 to Ellis, et al., which patent is owned by the assignee of the present invention and incorporated herein by this reference. Turn-assist cushions 74 are not necessarily a required element of the present invention.

A plurality of other support components 66, 72, 76, 78, 80, 84, 86, 90 are also provided in the embodiment of FIG. 3. One or more of these support components are provided to enable patient support 10 to be used in connection with a variety of different bed frames, in particular, a variety of bed frames having different deck configurations. One or more of these support components maybe selectively inflated or deflated or added to or removed from patient support 10 in order to conform patient support 10 to a particular deck configuration, such as a step or recessed deck or a flat deck.

The support components illustrated in FIG. 3 are made of foam, inflatable bladders, three-dimensional material, other suitable support material, or a combination of these. For example, as illustrated, head filler 66 includes a plurality of foam ribs extending transversely across patient support 10. Head filler 66 could also be an inflatable bladder. Filler portion 72 includes a foam layer positioned substantially underneath the sensor pads 68, 70 and extending transversely across the patient support 10. In the illustrated embodiment, filler portion 72 includes a very firm foam, such as polyethylene closed-cell foam, with a ½-inch thickness.

Head bolster assembly 76, seat bolster assembly 78, and foot section bolster assembly 86 each include longitudinally-oriented inflatable bladders spaced apart by coupler plates 144. Bolster assemblies 76, 78, 86 are described below with reference to FIG. 22.

As illustrated, first foot filler portion 80 includes a plurality of inflatable bladders extending transversely across patient support 10, and second foot filler portion 84 includes a foam member, illustratively with portions cut out to allow for retractability of the foot section or for other reasons. Deck filler portion 90 includes a plurality of transversely-extending inflatable bladders. As illustrated, deck filler portion 90 includes two bladder sections located beneath the head and seat sections of the mattress, respectively, and is located outside of cover 12. Deck filler portion 90 may include one or more bladder regions, or maybe located within interior region 14, without departing from the scope of the present invention.

Also provided in the illustrated embodiment are a pneumatic valve box 58 and an air supply tube assembly 82. Receptacle 88 is sized to house pneumatic valve box 58. In the illustrated embodiment, receptacle 88 is coupled to bottom cover portion 18 by Velcro® strips. Pneumatic box 58 is described below with reference to FIGS. 14A-B.

In the illustrated embodiment, support layer 20 includes a breathable or air permeable material which provides cushioning or support for a patient positioned thereon and allows for circulation of air underneath a patient. The circulated air maybe at ambient temperature, or maybe cooled or warmed in order to achieve desired therapeutic effects.

Also in the illustrated embodiment, support layer 20 includes or is enclosed in a low friction air permeable material (such as spandex, nylon, or similar material) enclosure that allows support layer 20 to move with movement of a patient on patient support 10, in order to reduce shear forces, for instance. In other embodiments, the enclosure is made of a non-air permeable, moisture/vapor permeable material such as Teflon or urethane-coated fabric.

In FIG. 4, an exemplary three-dimensional material suitable for use in support layer 20 is depicted. This illustrated embodiment of support layer 20 includes a plurality of alternating first and second layers 27, 29. Each layer 27, 29 includes first and second sublayers 28, 30. As shown, the sublayers 28, 30 are positioned back-to-back and each sublayer 28, 30 includes a plurality of peaks or semicircular, cone, or dome-shaped projections 22 and troughs or depressions 24. A separator material 26 is provided between the first and second sublayers 28, 30. In other embodiments, separator material 26 may instead or in addition be provided between the layers 27, 29, or not at all.

Any number of layers and sublayers maybe provided as maybe desirable in a particular embodiment of support layer 20. Certain embodiments include 4 layers and other embodiments include 8 layers. In general, 0-20 layers of three dimensional material are included in support layer 20.

Suitable three-dimensional materials for use in support layer 20 include a polyester weave such as Spacenet, manufactured by Freudenberg & Co. of Weinheim, Germany, Tytex, available from Tytex, Inc. of Rhode Island, U.S.A., and other woven, nonwoven, or knit breathable support materials or fabrics having resilient portions, microfilaments, monofilaments, or thermoplastic fibers. Other embodiments of support layers and suitable three dimensional materials are described us U.S. patent application Ser. No. 11/119,980, entitled PRESSURE RELIEF SUPPORT SURFACE, filed on May 2, 2005 and assigned to the assignee of the present invention, the disclosure of which is incorporated herein by this reference.

Figure 5:
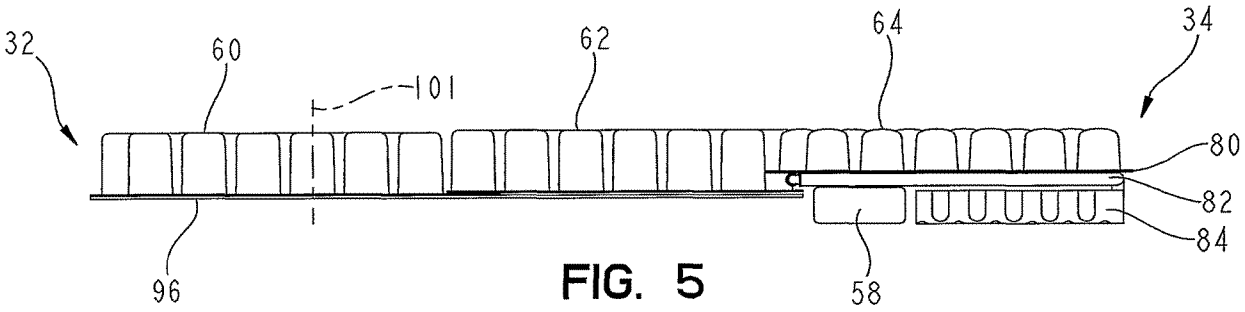
FIG. 5 is a side view of selected components of the illustrated embodiment of a patient support.

An exemplary second support layer including a base 96 and a plurality of inflatable bladders 50 is shown in the side view of FIG. 5. Inflatable bladders 50 extend upwardly away from base 96 along a vertical axis 101. Inflatable bladders 50 are arranged into a plurality of bladder zones, namely head bladder zone 60, seat bladder zone 62, and foot bladder zone 64. First and second foot filler portions 80, 84 and tube assembly 82 are located in the foot end 34 of patient support 10 below foot bladder assembly 64. Pneumatic valve box 58 is also located in foot end 34 of patient support 10 underneath foot bladder zone 64. In other embodiments, pneumatic box 58 maybe located elsewhere in patient support 10 or outside patient support 10.

Figure 6:
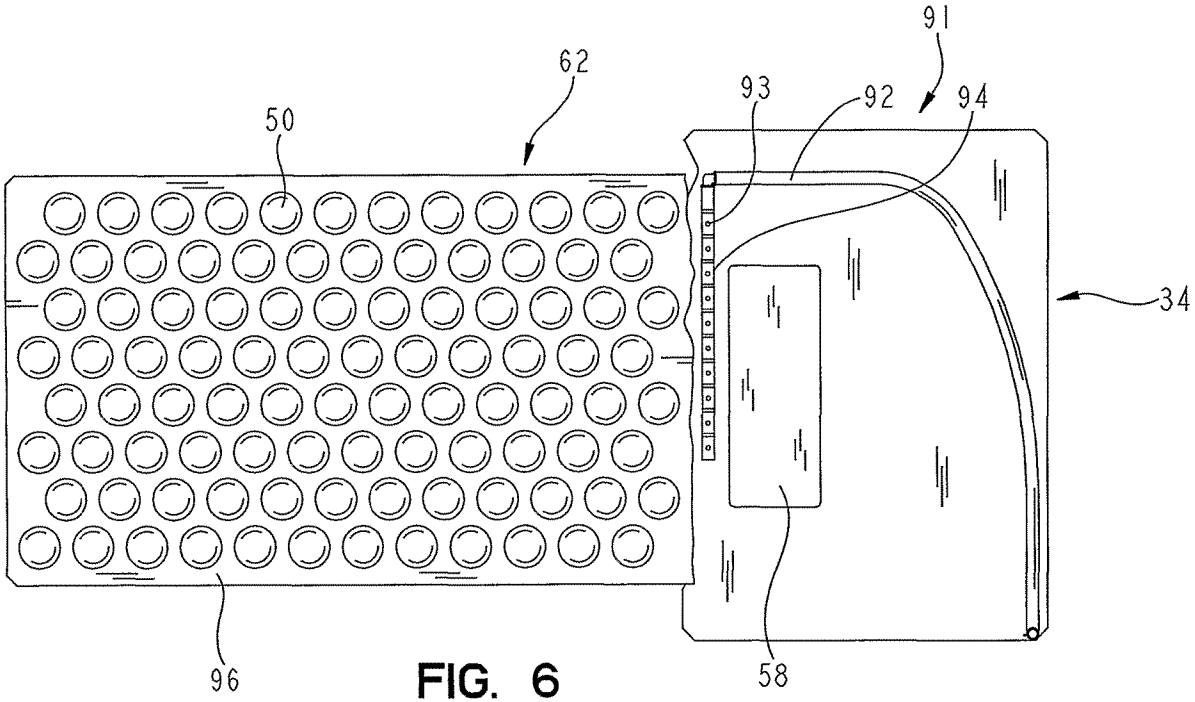
FIG. 6 is a top view of components of a patient support also shown in FIG. 5.

In FIG. 6, a top view of the above-described embodiment of patient support 10 is provided, with cover 12, support layer 20, and foot bladder assembly 64 removed to show the arrangement of one embodiment of a high air loss unit 91 and pneumatic box 58 in the foot section 34. High air loss unit 91 includes a delivery tube 92 and an air distributor 94. Pneumatic box 58 includes valves, circuitry, and other components for connecting vertical bladders 50 to an air supply 152 (FIG. 13) for inflation and deflation of vertical bladders 50. Pneumatic box 58 is described below with reference to FIGS. 14A and 14B. High air loss devices are similar to low air loss devices. A low air loss device typically includes openings to allow air to exit from the air bladders. As described in detail below, the air from a high air loss device does not exit from the air bladders. However, low air loss devices move air at about ½ cubic feet per minute (CFM) and high air loss devices, as described herein, move air at about 2 to 10 CFM. Both low air loss and high air loss devices aid in controlling the moisture and the temperature from the patient.

Delivery tube 92 is connected to an air supply and provides air to air distributor 94. In the illustrated embodiment, delivery tube extends transversely and/or diagonally across the width of patient support 10 and maybe curved or angled toward seat section bladder zone 62. Tube 92 and distributor 94 maybe made of a lightweight air impermeable material such as plastic.

As shown in FIG. 6, air distributor 94 is coupled to an end of delivery tube 92 located near seat section bladder zone 62. Air distributor 94 is an elongated hollow member including one or more apertures 93 which allow air to exit the tube 92 and circulate among vertical bladders 50 and three-dimensional material 20. In certain embodiments, the air is directed upwardly through support layer 20. A vent (not shown) is provided in cover 12 to allow the circulated air to exit interior region 14. The vent is generally located on the opposite end of patient support 10 from the supply tube 92. An additional vent maybe provided in the three-dimensional material enclosure, in embodiments where three-dimensional material 20 is enclosed in an enclosure within interior region 14 as discussed above. In those embodiments, the vent is also generally located opposite the supply tube 92.

In the illustrated embodiment, air provided by delivery tube 92 does not bleed upwardly through cover 12, however, in other embodiments cover 12 may include a breathable or air permeable material allowing for air to flow upwardly through the cover 12 to the patient. Also, in other embodiments, a single supply tube maybe provided in place of delivery tube 92 and air distributor 94. While shown in the illustrated embodiment, the above-described air circulating feature is not necessarily a required component of the present invention.

Figure 7:
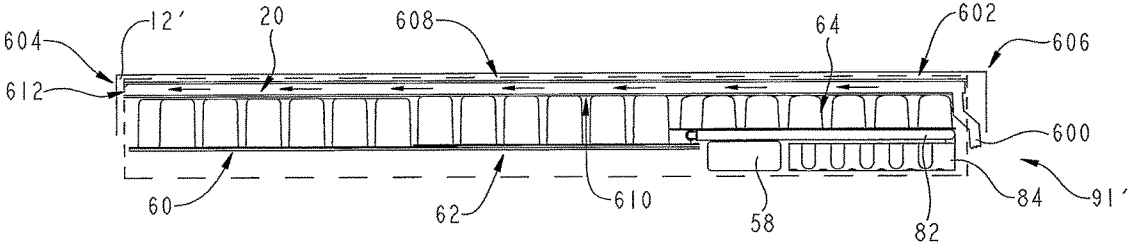
FIG. 7 is a side view of selected components of an alternative embodiment of a patient support.

An alternative embodiment of a high air loss device 91' is shown in FIGS. 7-10. As shown in FIG. 7, high air loss device 91' includes a supply tube 600 and an enclosure 602. Enclosure 602 includes a head end 604 and a foot end 606. Supply tube 600 attaches to enclosure 602 at the foot end 606. Enclosure 602 includes an oblong opening 612 near head end 604 for allowing air to exit the enclosure and the support layer 20 having a plurality of layers of three dimensional material, see above for greater description. As described above, the plurality of layers of three dimensional material may have the dimples facing upwards towards the patient or facing downward away from the patient. Enclosure 602 maybe formed of a vapor permeable and air impermeable material, as described above. Opening 612 may also include a series of slits.

Figure 8:
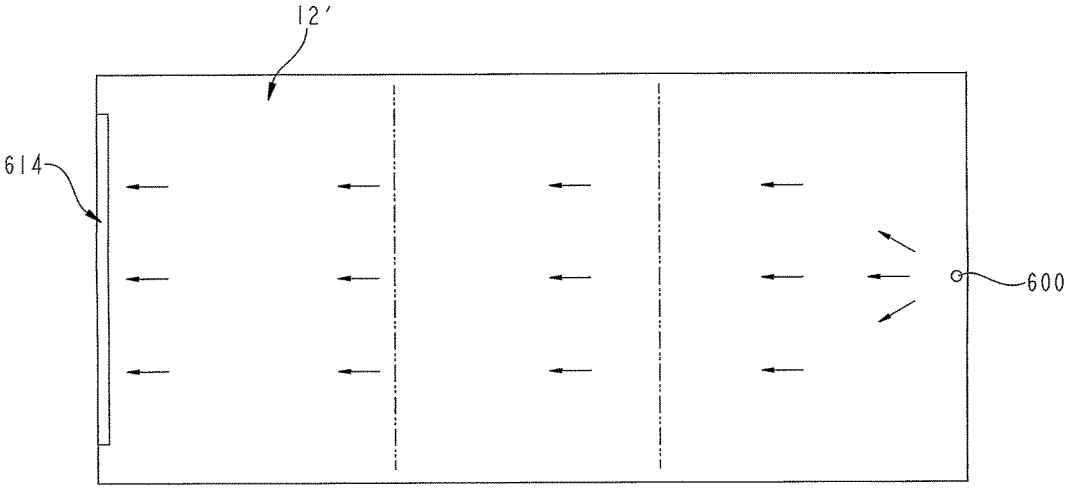
FIG. 8 is a top view showing air flow through the alternative embodiment of the patient support shown in FIG. 5.

As shown in FIGS. 7-8, when the high air loss device 91' is activated air flows towards the head end 606 through the support layer 20. The air flows out of opening 612 and exits the patient support 10 through a cover opening 614 in cover 12'. Cover opening 614 runs approximately the entire width of the cover 12' and includes snaps (not shown) to close portions of the opening. In alternative embodiments, opening 614 maybe be an air permeable material instead of an opening, or may include a zipper or Velcro® or hook and loop type fasteners instead of snaps.

Figure 9:
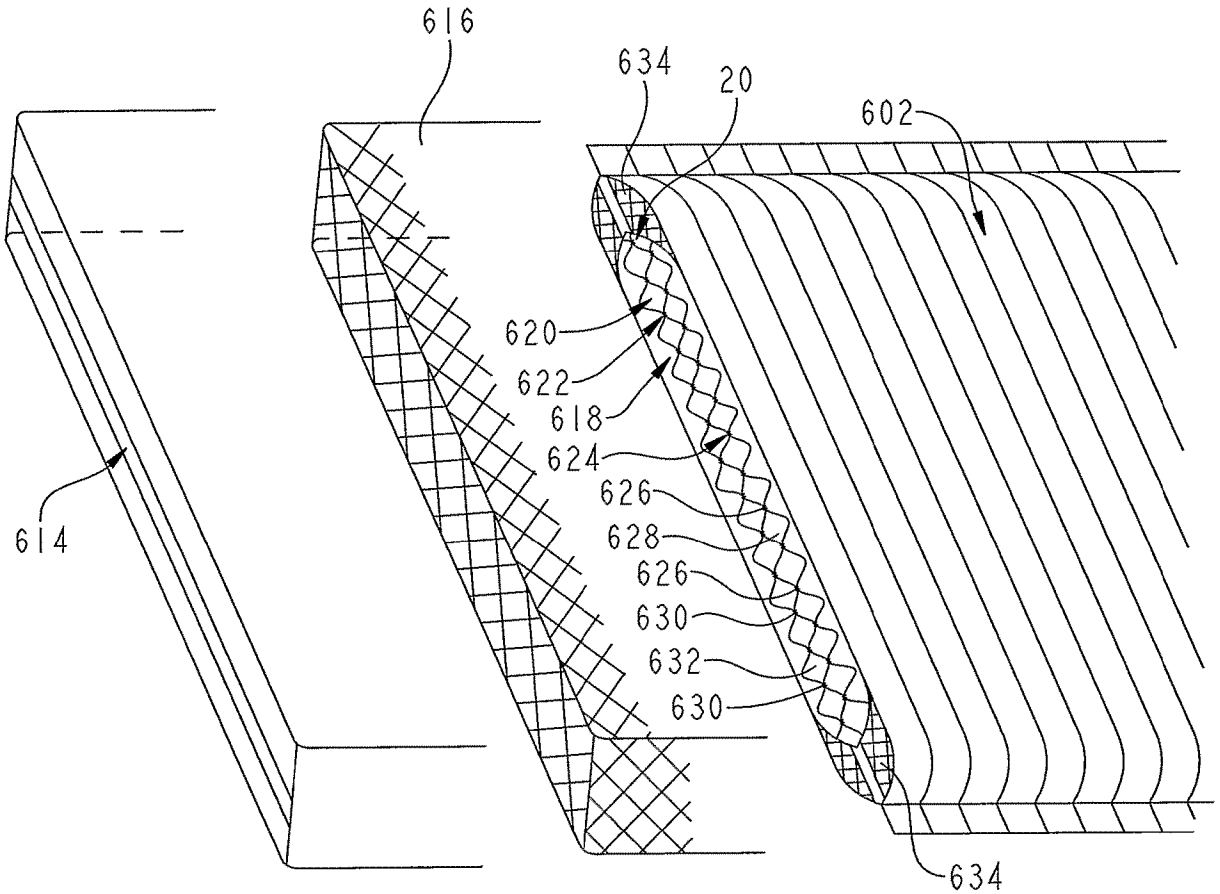
FIG. 9 is an exploded end view of the alternative embodiment of the patient support shown in FIG. 5.

As shown in FIG. 9, a fire resistant material 16 is placed on the enclosure 602. The fire resistant material 16 includes a loose weave making the fire resistant material air permeable. Additionally, support layer 20 includes first, second, third, and fourth layers of three dimensional material 618, 620, 622, 624. First layer 618 and second layer 620 are attached at a plurality of first attachment locations 626 forming a plurality of upper channels 628. Third layer 622 and fourth layer 624 are attached at a plurality of second attachment locations 630 forming a plurality of lower channels 632. Typically, an attachment point is located at a peak of one layer adjacent a valley of an adjoining layer. The air flows through upper and lower channels 628, 632. The air also flows through an outer region 634 located within the enclosure 602. Upper and lower channels 628, 632 allow air to more easily flow under the patient.

Figure 10:
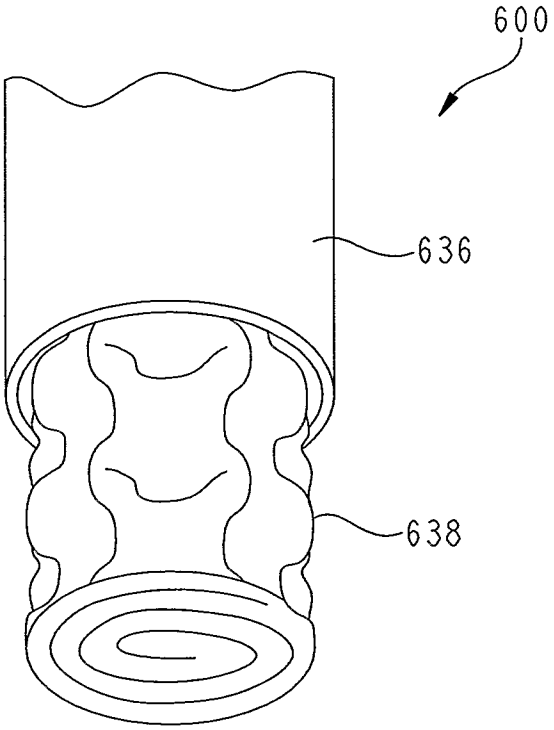
FIG. 10 is a perspective view of an air supply tube for a high air loss device.

One example of supply tube 600 is shown in FIG. 10. Supply tube 600 includes an outer body 636 and an inner body 638. Outer body 636 maybe formed of the same material as the enclosure. Inner body 638 is formed from a layer of rolled three dimensional material. The three dimensional material aids in preventing supply tube 600 from kinking or collapsing which may cut off or reduce the air supply to the enclosure 602. In alternative embodiments, supply tube 600 maybe formed from PVC, plastic, or any other conventional tubing material.

In alternative embodiments, enclosure 602 does not include support layer 20. In this embodiment, the opening 612 maybe located near foot end 606 or along at least one of the sides of the enclosure. In alternative embodiments, supply tube 600 attaches to enclosure 602 at the head end 604 or anywhere on the enclosure such as on a top surface 608, a bottom surface 610, or on a side surface (not shown) of the enclosure. In certain embodiments, supply tube 600 is integral with enclosure 602. In other embodiments, supply tube 600 attaches to a fitting (not shown).

In other embodiments, supply tube 600 is split by a T-fitting (not shown) and attaches to enclosure 602 in two or more locations. The supply tube in this embodiment is formed of PVC but may be formed from plastic or any other conventional tubing material. See Appendix A for additional information. Appendix A is expressly incorporated by reference herein.

Figure 12:
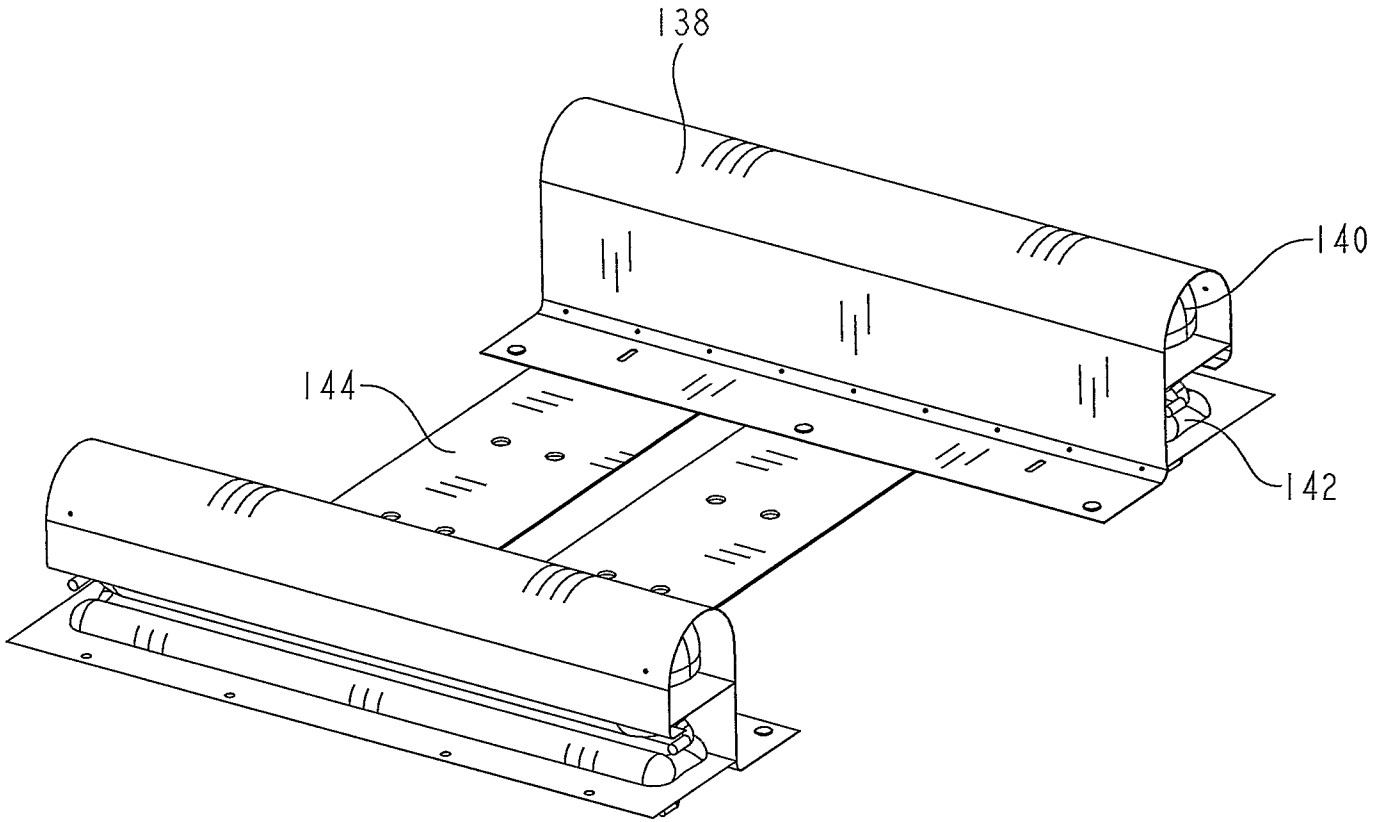
FIG. 12 is a perspective view of an exemplary bolster assembly.

FIG. 12 depicts a bolster assembly 76, 78. Bolster assemblies 76, 78 are generally configured to support portions of a patient along the longitudinal edges of patient support 10. One or more bolster assemblies 76, 78 maybe provided in order to conform patient support 10 to a particular bed frame configuration, to provide additional support along the edges of patient support 10, aid in ingress or egress of a patient from patient support 10, maintain a patient in the center region of patient support 10, or for other reasons. For example, internal air pressure of the bolster bladders maybe higher than the internal bladder pressure of assembles 60, 62, 64, or maybe increased or decreased in real time, to accomplish one of these or other objectives.

Each bolster assembly 76,78 includes a plurality of bolsters, namely, an upper bolster 140 and a lower bolster 142, with the upper bolster 140 being positioned above the lower bolster 142. Each upper and lower bolster combination 140, 142 is configured to be positioned along a longitudinal edge of patient support 10. Each upper and lower bolster combination 140, 142 is enclosed in a cover 138.

Figure 13:
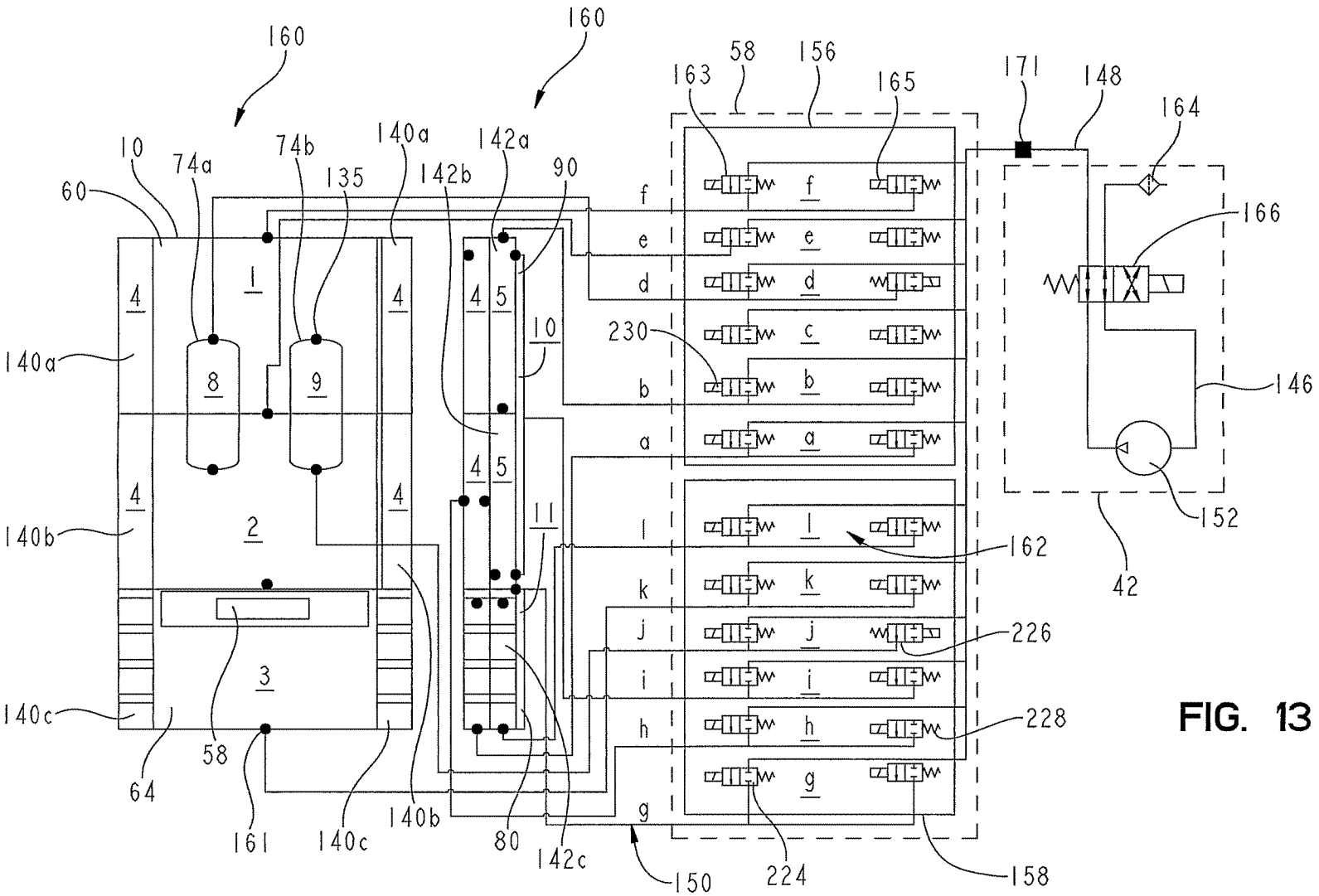
FIG. 13 is a schematic view of air zones of the illustrated patient support and associated air supply system.

In the illustrated embodiment, the bolsters 140, 142 are inflatable bladders. In other embodiments, either or both bolsters 140, 142 maybe constructed of foam, or filled with three-dimensional material, fluid, or other suitable support material. For example, in one embodiment, upper bolster 140 includes two layers of foam: a viscoelastic top layer and a non visco elastic bottom layer, while lower bolster 142 is an inflatable bladder. The bolsters 140, 142 maybe inflated together, or separately, as shown in FIG. 13, described below.

Each bolster combination 140, 142 is coupled to one end of one or more support plates 144 which provide support for other components of patient support 10 including vertical bladders 50. Support plates 144 maybe made of a substantially rigid or stiff yet lightweight material such as molded plastic. In other embodiments, plates 144 maybe constructed of stainless steel or steel, if additional weight is desired, i.e. for addition, collapsibility for ease of storage of patient support 10, for instance. Support plates 144 maybe provided in order to give support to patient support 10 particularly during transport, for ease of assembly, or for other reasons.

In the illustrated embodiment, each support plate 144 is a rectangular member extending transversely across the width of the mattress 10. As shown in the drawings, there are five such rib-like members 144 spaced apart underneath the head and seat sections of the mattress. In other embodiments, each support plate 144 has its middle section (i.e., the section extending transversely) cut out so that only the two plate ends remain at each spaced-apart end (underneath the bolsters); thereby providing five pairs of support plates 144 spaced apart along the longitudinal length of the mattress 10.

Bolster assembly 86 is similar to bolster assemblies 76, 78 except that its upper layer includes the vertical bladders 50 of longitudinal sections 214, 216. Bolster assembly 86 has a longitudinally-oriented bladder as its lower bolster portion.

A schematic diagram of the pneumatic control system of patient support 10 is shown in FIG. 13. Reading FIG. 13 from second to first, there is shown a simplified top view of patient support 10 with portions removed to better illustrate the various air zones 160, a simplified side view of patient support 10, a schematic representation of pneumatic valve box 58, a schematic representation of control unit 42, and air lines 146, 148, 150 linking control unit 42, valve box 58, and air zones 160.

As shown in FIG. 13, air zones 160 of patient support 10 are assigned as follows: zone 1 corresponds to head section bladder assembly 60, zone 2 corresponds to seat section bladder assembly 62, zone 3 corresponds to foot section bladder assembly 64, zone 4 corresponds to upper side bolsters 140, zone 5 corresponds to lower side bolsters 142, zone 6 corresponds to upper foot bolsters 140, zone 7 corresponds to lower foot bolsters 142, zone 8 corresponds to first turn-assist bladder 74, zone 9 corresponds to second turn-assist bladder 74, zone 10 corresponds to deck filler 90, and zone 11 corresponds to foot filler 80.

An air line 150 couples each zone 160 to a valve assembly 162 in valve box 58. Valve box 58 is located in the foot section 34 of patient support 10. Illustratively, valve box 58 is releasably coupled to bottom portion 18 of cover 12 in interior region 14, i.e., by one or more Vecro®-brand fasteners or other suitable coupler.

Each air line 150 is coupled at one end to an inlet port 135 on the corresponding bladder or bladder assembly. Each air line 150 is coupled at its other end to a valve assembly 162. Each valve assembly 162 includes first or fill valve 163 and a second or vent valve 165. First valves 163 are coupled to air supply 152 of control unit 42 by air lines 148. First valves 163 thereby operate to control inflation of the corresponding zone 160 i.e. to fill the zone with air. Second valves 165 operate to at least partially deflate or vent the corresponding zone 160, for example, if the internal air pressure of the zone 160 exceeds a predetermined maximum, or if deflation is necessary or desirable in other circumstances (such as a medical emergency, or for transport of patient support 10).

Each valve 163, 165 has an open mode 224 and a closed mode 226, and a switching mechanism 228 (such as a spring) that switches the value from one mode to another based on control signals from control unit 42. In closed mode 226, air flows from air supply 152 through the value 163 to the respective zone 160 to inflate the corresponding bladders, or in the case of vent valves 165, from the zone 160 to atmosphere. In open mode 228, no inflation or deflation occurs.

In the illustrated embodiment, an emergency vent valve 230 is provided to enable quick deflation of turning bladders 74 which draws air from atmosphere through a filter 164 and also vents air to atmosphere through filter 164. Air supply 152 is an air pump, compressor, blower, or other suitable air source.

Air supply 152 is coupled to a switch valve 155 by air line 146. Switch valve 166 operates to control whether inflation or deflation of a zone occurs. An optional proportional valve 171 maybe coupled to air line 148 to facilitate smooth inflation or deflation of turn-assist bladders 74, or for other reasons.

In the illustrated embodiment, valve box 58 includes a first valve module 156 and a second valve module 158. First valve module 156 includes valves generally associated with a patient's first side (i.e., first side, from the perspective of a patient positioned on patient support 10) and second valve module 158 includes valves generally associated with a patient's second side (i.e., second side).

The various zones 160 are separately inflatable. Certain of the zones 160 are inflated or deflated to allow patient support 10 to conform to different bed frame configurations. For example, the deck filler 90 (zone 10 in FIG. 23) is inflated to conform patient support 10 to certain bed frame configurations, such as step deck configurations including the TotalCare® and CareAssist® bed frames, made by Hill-Rom, Inc., the assignee of the present invention, but is deflated when patient support 10 is used with a flat deck bed frame, such as the Advanta® bed made by Hill-Rom, Inc. As another example, the foot filler 80 (zone 11 in FIG. 23) is inflated when patient support 10 is used with the VersaCare®, TotalCare®, or CareAssist® beds, but the lower side bolsters 142 (zone 5 in FIG. 23) are not inflated when patient support 10 is used with a VersaCare® bed. As still another example, the lower foot bolsters 142 (zone 7 in FIG. 23) are inflated when patient support 10 is used on flat decks or other bed frames, including the Advanta® and VersaCare® bed frames made by Hill-Rom, Inc.

Figure 11A:
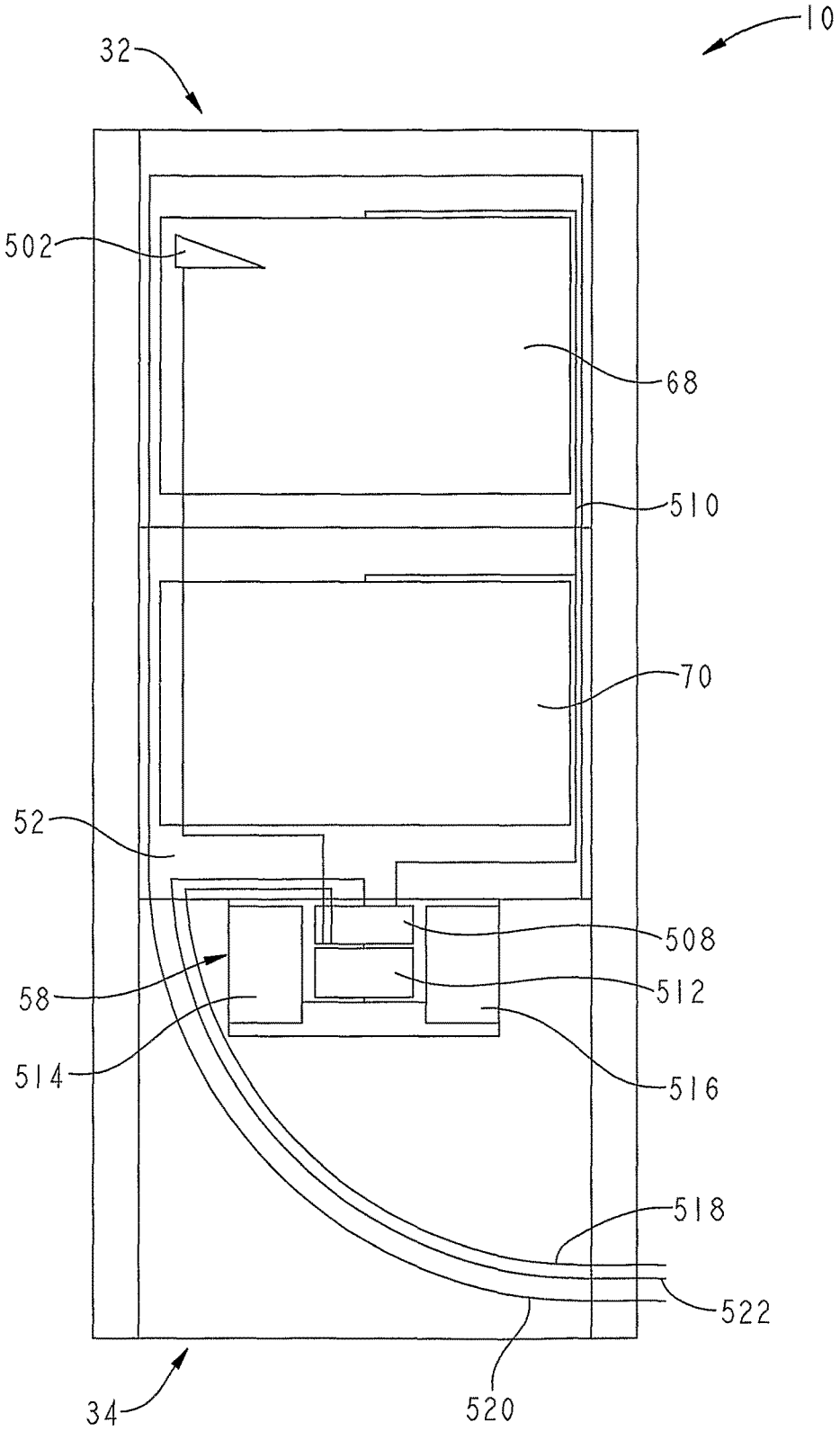
FIGS. 11A and 11B are schematic diagrams of portions of a control system for the illustrated patient support.
Figure 11B:
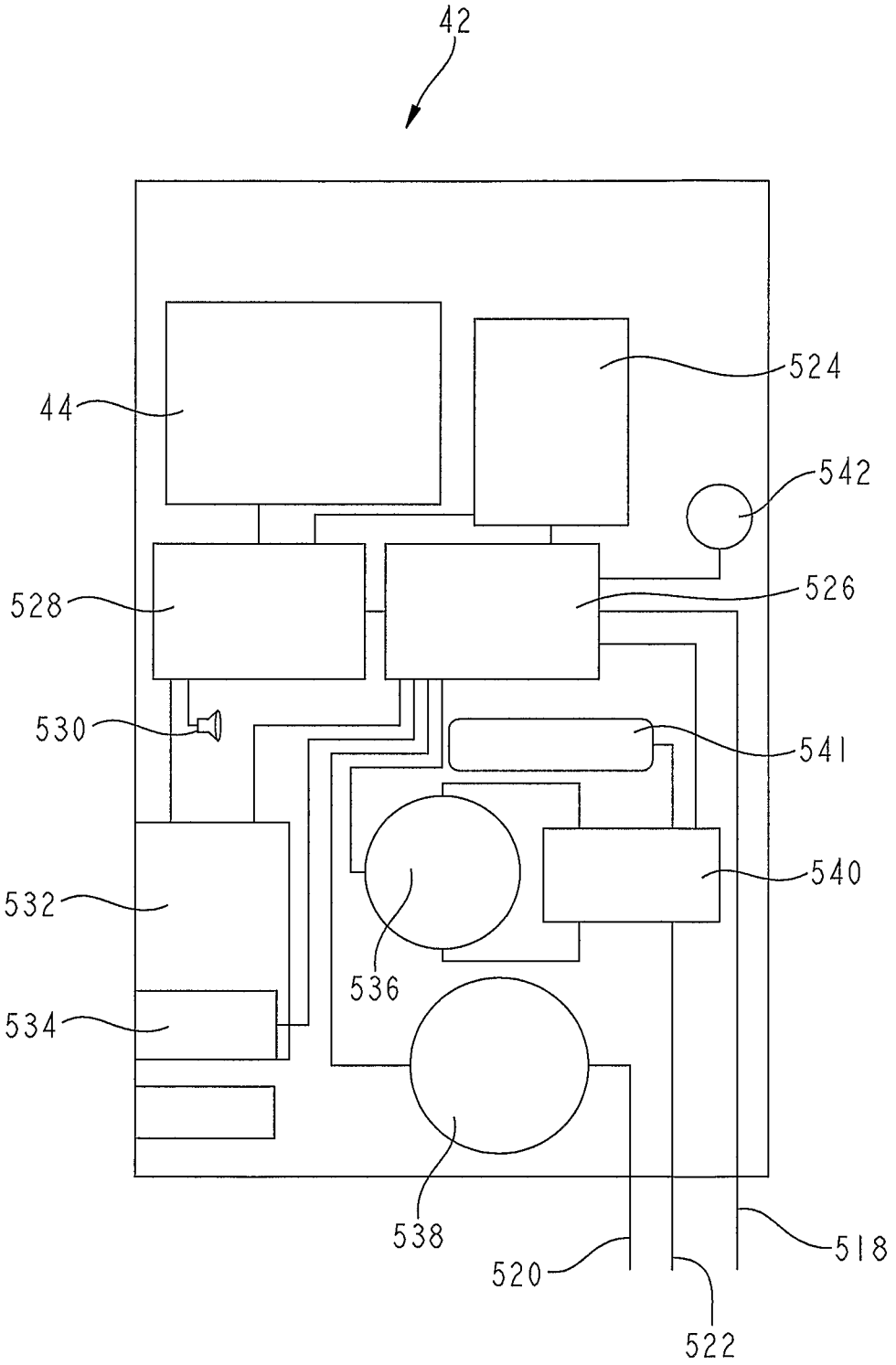

FIGS. 11A and 11B are a simplified schematic diagram of a control system and the patient support or mattress 10 of the present invention. FIG. 24A illustrates the patient support 10 including the various components of patient support 10 whereas FIG. 24B illustrates the control unit 42 and various components therein. The patient support 10 includes the sensor pad 52 which is coupled to the pneumatic valve control box 58 as previously described. The sensor pad 52 includes a head sensor pad 68 and a seat sensor pad 70. The head sensor pad 68 is located at the head end 32 of the mattress 10. The seat sensor pad 70 is located at a middle portion of the mattress 10 which is located between the head end 32 and a location of the pneumatic valve control box 58. The seat sensor pad 70 is located such that a patient laying upon the mattress 10 may have its middle portion or seat portion located thereon when in a reclined state. In addition, when the head end 32 of the mattress 10 is elevated, the seat portion of the patient is located upon the seat sensor pad 70. As previously described with respect to FIG. 3, the head sensor pad 68 is located beneath the head section bladder assembly 60 and the seat sensor pad 70 is located beneath the seat section bladder assembly 62. Each one of the sensors of the head sensor pad 68 or the seat sensor pad 70 is located beneath on at least adjacent to one of the upstanding cylindrical bladders or cushions 50. A head angle sensor 502 is coupled to the control box 58 where signals received from the sensor 52 may provide head angle information and pressure adjustment information for adjusting pressure in the seat bladders 62.

The sensor pad 52 is coupled through the associated cabling to the pneumatic control box 58. The pneumatic control box 58 includes a multiplexer 508 coupled to the head sensor pad 68 and the seat sensor pad 70 through a signal and control line 510. The multiplexer board 508 is also coupled to an air control board 512 which is in turn coupled to a first valve block 514 and a second valve block 516. A communication/power line 518 is coupled to the control unit 42 of FIG. 11B. Likewise, a ventilation supply line 520 which provides for air flow through the patient support 10 for cooling as well as removing moisture from the patient is also coupled to the control unit 42 of FIG. 11B. An air pressure/vacuum supply line 522 is coupled to the control unit 42 as well.

The control unit 42 of FIG. 11B, also illustrated in FIG. 1, includes the display 44, which displays user interface screens, and a user interface input device 524 for inputting to the control unit 42 user selectable information, such as the selection of various functions or features of the present device. The selections made on the user interface input device 524 control the operation of the patient support 10, which can include selectable pressure control of various bladders within the mattress 10, control of the deck 6, for instance to put the bed 2 in a head elevated position, as well as displaying the current state of the mattress or deck position, and other features.

An algorithm control board 526 is coupled to the user interface input device 524. The algorithm control board 526 receives user generated input signals received through the input device 524 upon the selection of such functions by the user. The input device 524 can include a variety of input devices, such as pressure activated push buttons, a touch screen, as well as voice activated or other device selectable inputs. The algorithm control board 526 upon receipt of the various control signals through the user input device 524 controls not only the operation of the mattress 10 but also a variety of other devices which are incorporated into the control unit 42. For instance, the algorithm control board 526 is coupled to a display board 528 which sends signals to the display 44 to which it is coupled. The display board 528 is also connected to a speaker 530 which generates audible signals which might indicate the selection of various features at the input device 24 or indicate a status of a patient positioned on patient support (e.g. exiting) or indicate a status of therapy being provided to the patient (e.g., rotational therapy complete). The algorithm control board 526 receives the required power from power supply 532 which includes an AC input module 534, typically coupled to a wall outlet within a hospital room.

The algorithm control board 526 is coupled to an air supply, which, in the illustrated embodiment includes a compressor 536 and a blower 538. Both the compressor 536 and the blower 538 receive control signals generated by the algorithm control board 526. The compressor 536 is used to inflate the air bladders. The blower 538 is used for air circulation which is provided through the ventilation supply line 520 to the mattress 10. It is, however, possible that the compressor 536 maybe used to both inflate the bladders and to circulate the air within the mattress 10. A pressure/vacuum switch valve 540 is coupled to the compressor 536 which is switched to provide for the application of air pressure or a vacuum to the mattress 10. A muffler 541 is coupled to the valve 540. In the pressure position, air pressure is applied to the mattress 10 to inflate the mattress for support of the patient. In the vacuum position, the valve 540 is used to apply a vacuum to the bladders therein such that the mattress maybe placed in a collapsed state for moving to another location or for providing a CPR function, for example. A CPR button 542 is coupled to the algorithm control board 526.

As illustrated, the algorithm control board 526, the compressor 536, the blower 538, and the user input device or user control module 524 are located externally to the mattress and are a part of the control unit 42, which maybe located on the footboard 38 as shown in FIG. 1. The sensors and sensor pad 52, the pneumatic valve control box 58, and the air control board or microprocessor 512 for controlling the valves and the sensor pad system 52 are located within the mattress 10. It is within the present scope of the invention to locate some of these devices within different sections of the overall system, for instance, such that the algorithm control board 526 could be located within the mattress 10 or the air control board 512 could be located within the control unit 42.

Figure 14A:
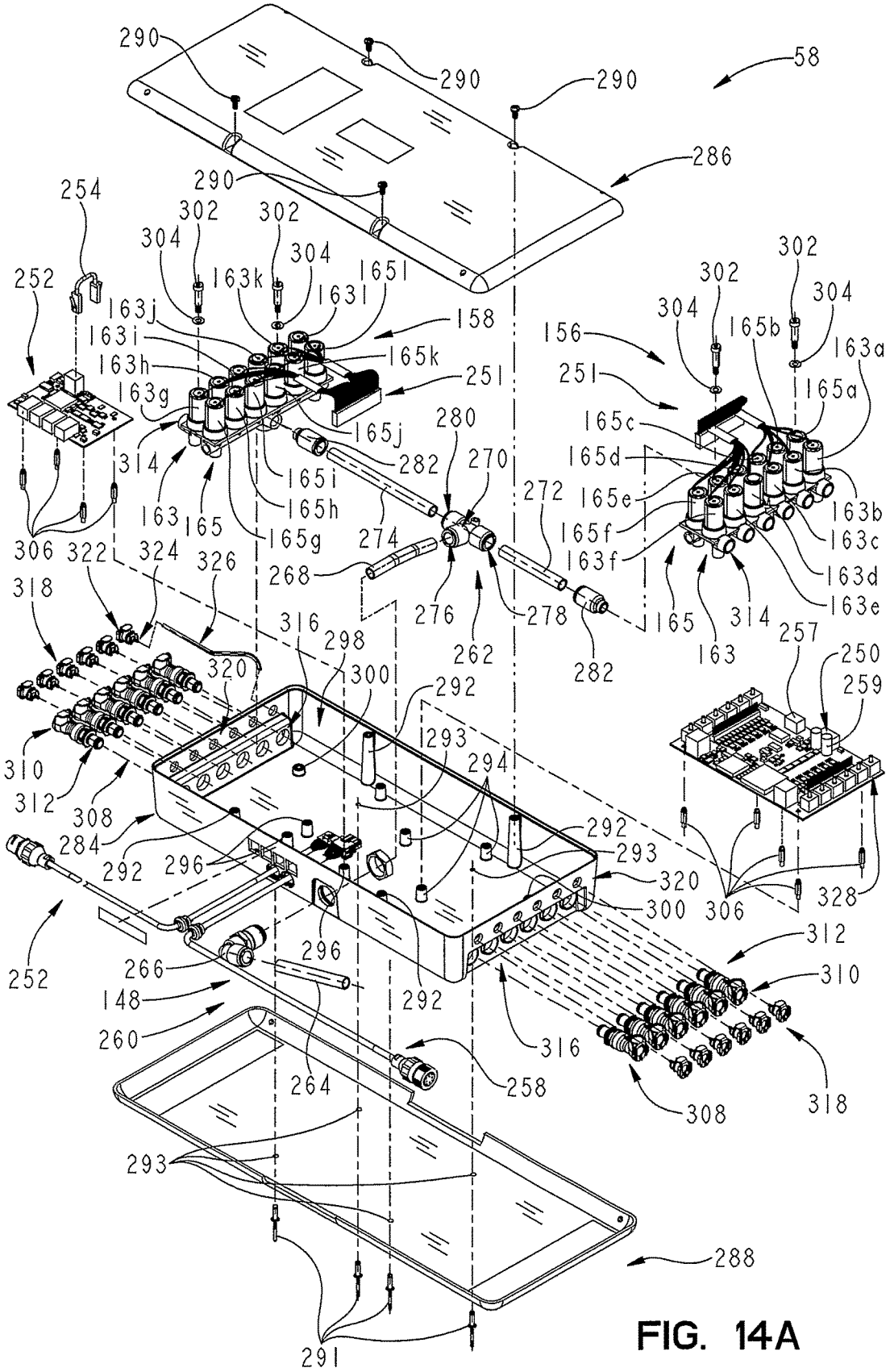
FIG. 14A is an exploded view of an exemplary pneumatic assembly.
Figure 14B:
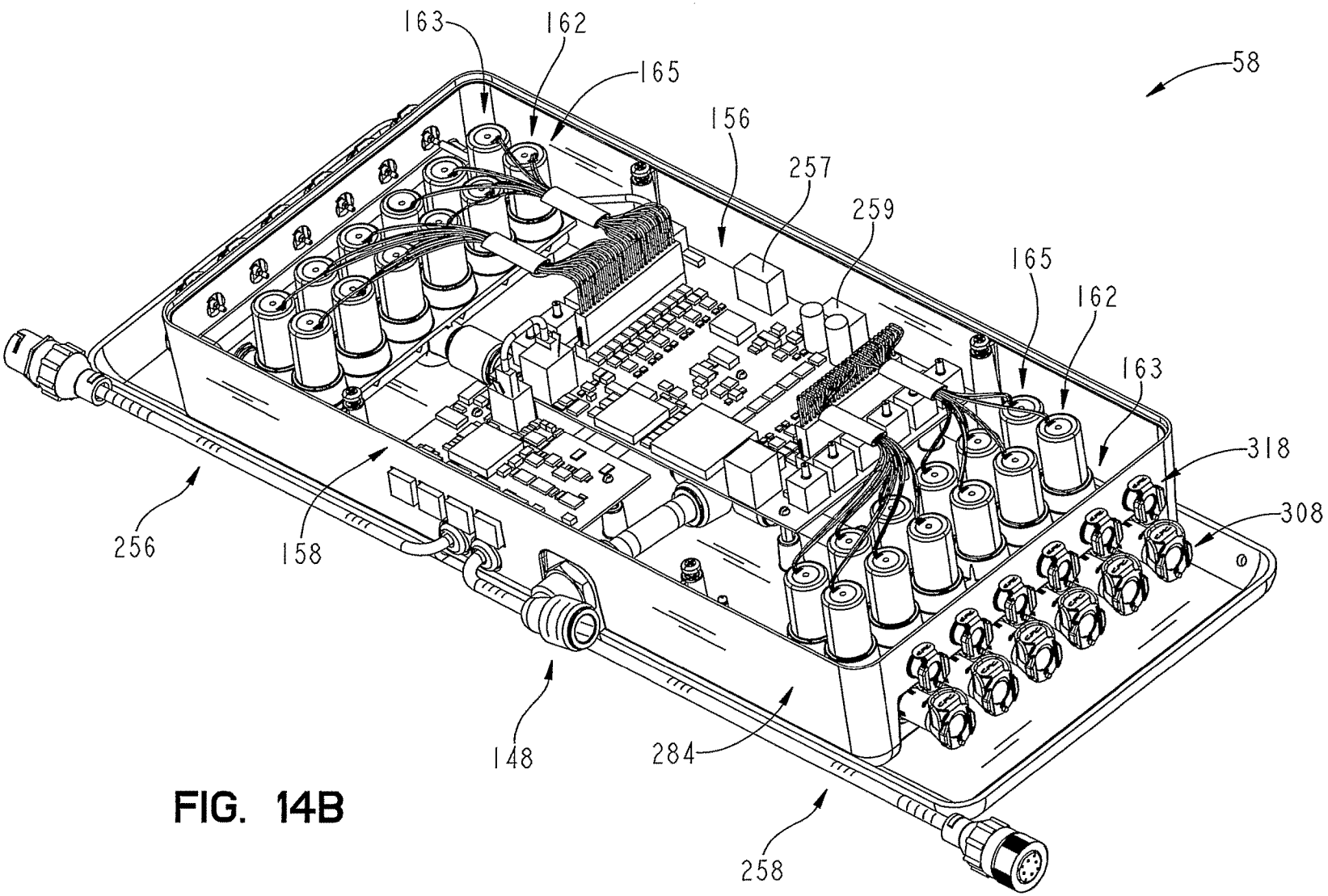
FIG. 14B is a perspective view of the pneumatic assembly of FIG. 14A

As shown in FIGS. 14A-14B, control box 58 includes a multiplexer 252 and an air control board 250. Control board 250 is coupled to multiplexer 252 by a jumper 254. Multiplexer 252 is further coupled to head sensor pad 68 and seat sensor pad 70 through a signal and control line (not shown). Control board 250 is also coupled to first valve module 156 and second valve module 158 by wire leads 251. A communication/power line 258 couples control board 250 to the control unit 42. Communication line 258 couples to a communication plug 259 of control board 250. Jumper 254 couples multiplexer 252 to control board 250 for power and access to communication line 258. Wire leads 251 provide actuation power to first and second valve modules 156, 158.

As discussed above, first and second valve modules 156, 158 include fill valves 163 and vent valves 165. First valve module 156 includes fill valves 163*a-f* and vent valves 165*a-f*. Second valve module 156 includes fill valves 163*g-l* and vent valves 165*g-l*. Fill valves 163*a-l* and vent valves 165*a-l* are 12 Volt 7 Watt solenoid direct active poppet style valves in the illustrated embodiment. Control board 252 is able to actuate each fill valve 163*a-l* and vent valve 165*a-l* independently or simultaneously. Fill valves 163*a-l* and vent valves 165*a-l* are all able to be operated at the same time. In operation to initiate each valve 163, 165, control board 250 sends a signal to the valve to be operated. The signal causes a coil (not shown) within each valve to energize for ½ second and then switches to pulsate power (i.e., turn on and off at a high rate) to save power during activation. The activation in turn cause the valve to either open or close depending on which valve is initiated.

Fill valves 163 are coupled to air supply 152 of control unit 42 by second air line 148. Air line 148 includes an outer box line assembly 260 and an inner box line assembly 262. Outer box line assembly 260 includes an exterior inlet hose 264 and an elbow 266 coupled to exterior inlet hose 264. Inner box line assembly 262 includes an interior inlet hose 268 coupled to elbow 266, a union tee connector 270, a first module hose 272, and a second module hose 274. Connector 270 includes a first opening 276 to receive interior inlet hose 268, a second opening 278 to receive first module hose 272, and a third opening 280 to receive second module hose 274. First and second module hoses 272, 274 each couple through a male coupler 282 to first and second valve modules 156, 158 respectively. In operation, air from air supply 152 travels through supply line 148, enters outer box line assembly 260 through exterior inlet hose 264 and passes through elbow 266 to interior inlet hose 268. The air then travels from inlet hose 268 to union tee connector 270 where the air is divided into first module hose 272 and second module hose 274. The air passes through first and second module hoses 272, 274 into first and second valve modules 156, 158 respectively. The operation of first and second valve modules 156, 158 is described below.

Control box 58 includes a base 284, a cover 286, and a tray 288. Cover 286 includes a plurality of fasteners (i.e., screws) 290. Base 284 includes a plurality of threaded cover posts 292. Cover posts 292 are configured to receive screws 290 to couple cover 286 to base 284. Cover 286 and base 284 define an inner region 298. Tray 288 couples to base 284 with a plurality of rivets 291 riveted through a plurality of rivet holes 293 located on tray 288 and base 284.

Inner box line assembly 262, first valve module 156, second valve module 158, control board 250, and multiplexer 252 are contained within inner region 298. Base 284 further includes a plurality of control board posts 294, a plurality of multiplexer posts 296, and a plurality of module posts 300. First and second valve modules 156, 158 are coupled to module posts 300 by shoulder screws 302 and washers 304. Control board 250 and multiplexer 252 are respectively coupled to control board posts 294 and multiplexer posts 296 by a plurality of snap mounts 306.

First and second valve modules 156, 158 attach to third air lines 150 *a, b, d-f*, and *g-l* through a plurality of couplers 308. Couplers 308 include a first end 310 and a second end 312. Third air lines 150 *a, b, d-f*, and *g-l* each include a fitting (not shown) receivable by second end 312. Each first end 310 mounts to a port 314 in first and second valve modules 156, 158. First end 310 mounts through a plurality of openings 316 in base 284.

A plurality of feedback couplers 318 mount through a plurality of feedback openings 320 in base 284. Feedback couplers 318 include a first feedback end 322 and a second feedback end 324. First feedback end 322 couples to a feedback line (not shown) that in turn couples to a feedback port 135 located on each air zone 160. Second feedback end 324 receives a feedback transfer line 326. Each transfer line 326 couples to a pressure transducer 328 located on the control board 250. Pressure transducer 328 receives the pressure from each air zone 160 and transmits to control unit 42 a pressure data signal representing the internal air pressure of the zone 160. Control unit 42 uses these pressure signals to determine the appropriate pressures for certain mattress functions such as CPR, patient transfer, and max-inflate. Pressure signals from the transducer 328 coupled to the foot zone 160*k* are also used to maintain optimal pressure in foot zone 160*k*. In the illustrated embodiment, pressure in foot zone 160*k* (zone 3) is computed as a percentage of the pressure in seat zone 160*e* (zone 2). The pressures in seat zone 160*e* and head zone 160*f* are determined using both the transducers 328 and the pressure sensors 136. The pressures in one or more of the zones 160 maybe adjusted in real time.

As shown in FIG. 13, fill valves 163*a-l* and vent valves 165*a-l* are coupled to various portions of patient support 10 through third air lines 150 *a, b, d-f*, and *g-l*. Fill valve 163*a* and vent valve 165*a* are coupled to upper foot bolsters 140*c*, fill valve 163*b* and vent valve 165*b* are coupled to lower side bolsters 142 *a, b*, fill valve 163*c* is coupled to atmosphere and vent valve 165*c* is reserved for future therapies. Also, fill valve 163*d* and vent valve 165*d* are coupled to first turn assist 74*a*, fill valve 163*e* and vent valve 165*e* are coupled to seat bladders 62, fill valve 163*f* and vent valve 165*f* are coupled to head bladder assembly 60, fill valve 163*g* and vent valve 165*g* are coupled to foot filler 80, fill valve 163*h* and vent valve 165*h* are coupled to upper side bolsters 140 *a, b*, fill valve 163*i* and vent valve 165*i* are coupled to deck filler 90, fill valve 163*j* and vent valve 165*j* are coupled to first turn assist 74*b*, fill valve 163*k* and vent valve 165*k* are coupled to foot bladders 164, fill valve 163*l* and vent valve 165*l* are coupled to lower foot bolsters 142*c*. Vent valves 165*d, j* are biased in the open position to vent air from first and second turn assist 74*a*, 74*b* when first and second turn assist 74*a*, 74*b* are not in use. Vent valves 165*d, j* return to their open position if the mattress loses power or pressure venting air from the first and second turn assist 74*a*, 74*b*. When air is vented from a zone 160, the pressure in the zone 160 after deflation is determined by the control system 42, 58 in real time rather than being predetermined.

In one embodiment, a user enters an input command to control unit 42. Control unit 42 processes the input command and transmits a control signal based on the input command through communication line 258 to control board 250. Additionally or alternatively, control signals could be based on operational information from control unit 42 to increase or decrease pressure within one or more of the zones 160 based on information obtained from transducers 328 and/or sensors 136.

It should be noted that in the illustrated embodiment, the mattress controls 42, 58 are independent from operation of the bed frame 4. In other embodiments, however, bed frame 4 and mattress 10 maybe configured to exchange or share data through communication lines. For instance, data is communicated from bed frame 4 to mattress system 42, 58 and used to adjust support parameters of mattress 10. For instance, in one embodiment, a signal is transmitted from frame 4 when foot section 34 is retracting, so that mattress systems 42, 58 responds by decreasing internal pressure of vertical bladders 50 in foot assembly 64.

As described above, air supply 152 is capable of supplying air or acting as a vacuum to remove air from zones 160. While in supply mode, a microprocessor on control board 250 actuates corresponding fill valve 163*a-l* or vent valve 165*a-l* based on the control signal from control unit 42. For example, if the control signal indicates the pressure in head bladder assembly 160 is to be increased fill valve 163*f* is actuated. However, if the control signal indicates the pressure in head bladder assembly 160 is to be decreased vent valve 165*f* is actuated. While in vacuum mode one or more fill valves 163*a-l* maybe actuated to allow for rapid removal of air within the corresponding zones.

Figure 15:
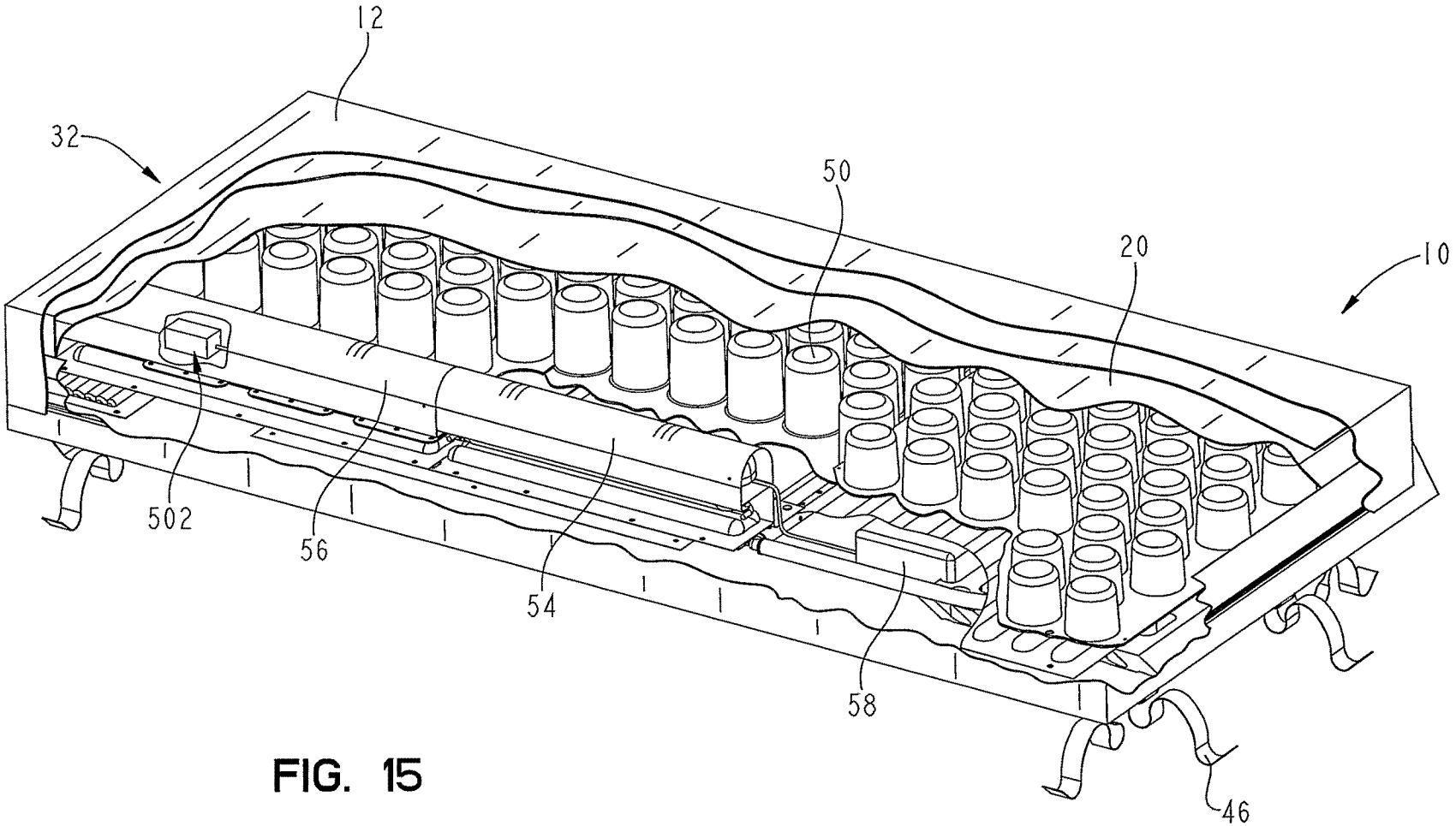
FIG. 15 is a perspective view of a patient support, with a portion being cut away to show interior components, including an angle sensor, of the patient support.

An angle sensor cable 256 is provided to send a signal from a head angle sensor 502 to the control board 250. Angle sensor cable 256 couples to an angle plug 257 of control board 250. In the illustrated embodiment, head angle sensor 502 is located within head bolster assembly 76 as indicated by FIGS. 11A and 15. Head angle sensor 502 indicates the angle of elevation of the head end 32 of bed 2 as the head section of the frame 4 articulates upwardly raising the patient's head or downwardly lowering the patient's head. In one embodiment, angle sensor 502 transmits the angle of head end 32 to all nodes or circuit boards within the mattress control system 42, 58. Angle sensor 502 generates an indication or indicator signal when head end 32 is at an angle of at least 5°, at least 30°, and at least 45°. The head angle indication is transmitted to the control unit 42 which evaluates and processes the signal. When head end 32 is at an angle above 30° turn assist 74 becomes inoperative primarily for patient safety reasons. When head end 32 is at an angle above 45° information is transmitted to control unit 42 for use in the algorithms. The 5° angle indication is primarily to ensure relative flatness of patient support 10. In the illustrated embodiment, angle sensor 502 is a ball switch. In an alternative embodiment, angle sensor 502 maybe a string potentiometer.

Figure 16A:
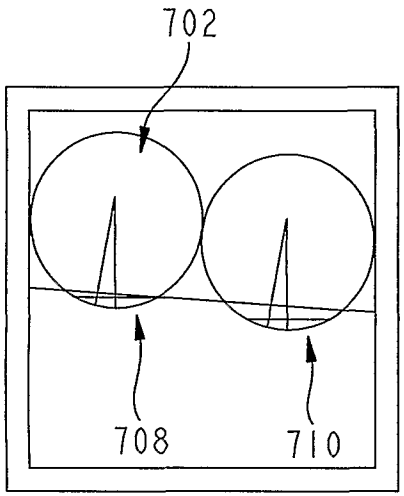
FIGS. 16A-C are diagrammatic views showing ball switches located within the angle sensor.
Figure 16B:
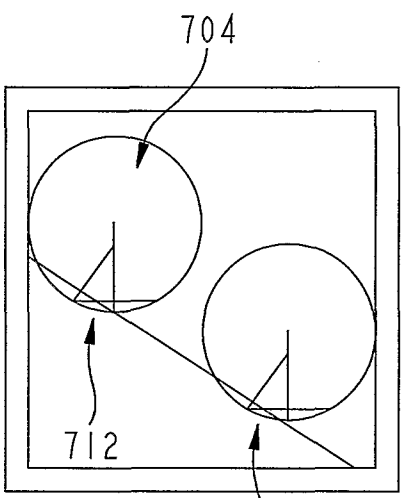
Figure 16C:
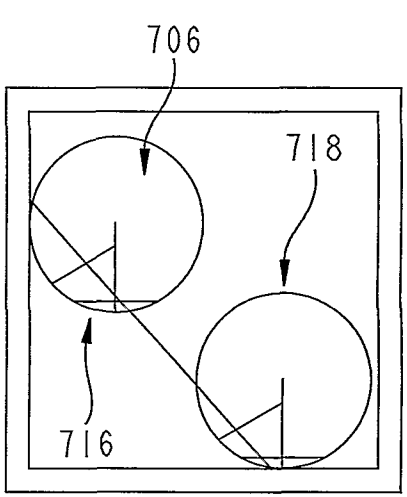

As shown in FIGS. 16A-16C, three balls 702, 704, 706 are provided within angle sensor 502. First ball 702 actuates when the head end 32 is at an angle of at least 5° moving first ball 702 from a first position 708 to a second position 710. Second ball 704 indicates when the head end 32 is at an angle of at least 30° moving second ball 704 from a first position 712 to a second position 714. Third ball 706 indicates when the head end 32 is at an angle of at least 45° moving third ball 706 from a first position 716 to a second position 718.

Figure 17:
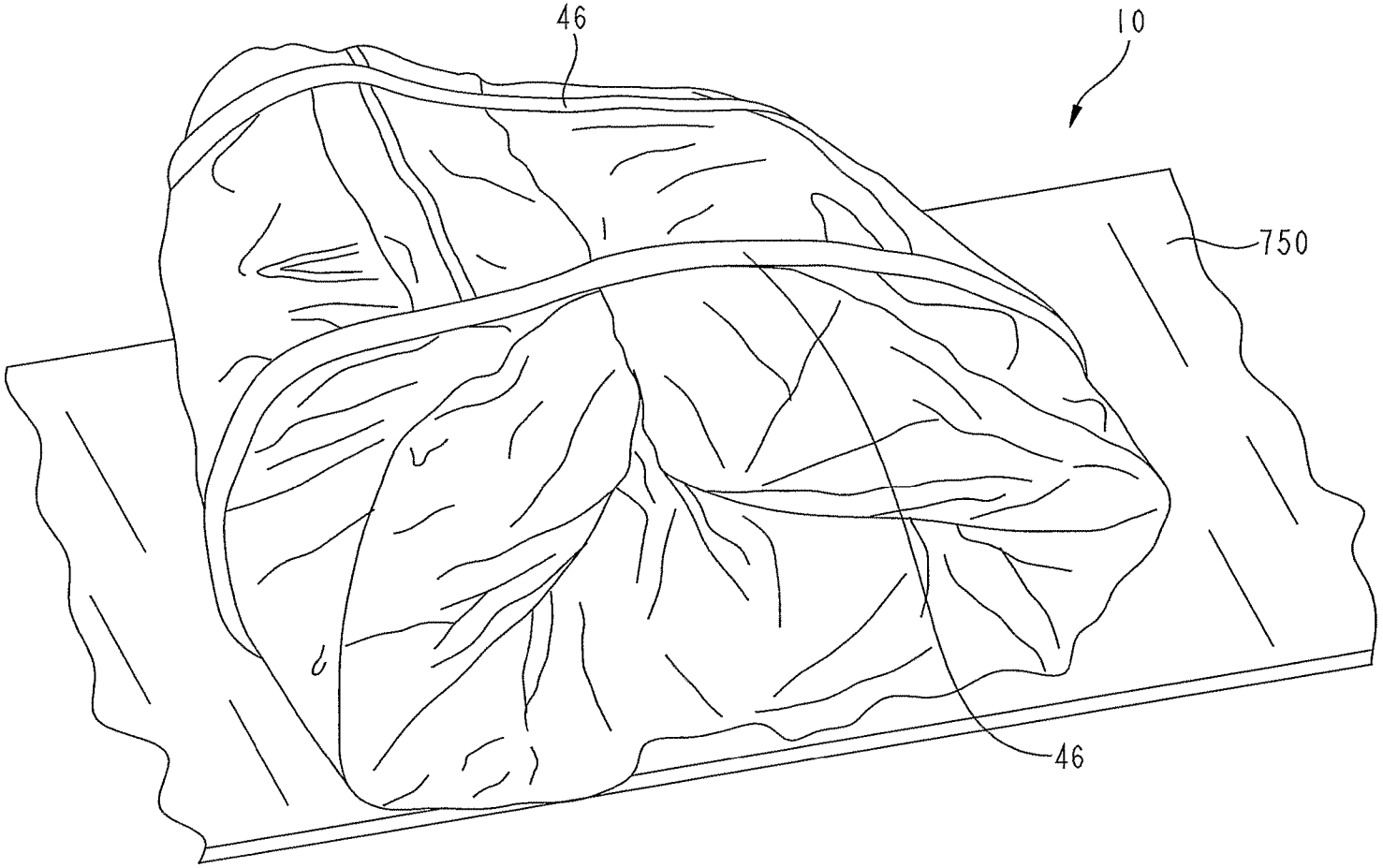
FIG. 17 is a perspective view of the patient support in a transportation position.

FIG. 17 shows patient support 10 in a transportation position on a pallet 750. As discussed above, air supply 42 is capable of providing a vacuum to evacuate the air from within patient support 10. This allows patient support 10 to be folded. As shown in FIG. 17, couplers 46 hold patient support 10 in the transportation position. Support plates 144 are provided as separate plates to aid in the folding process. As patient support 10 is folded, any remaining air not evacuated by the air supply 42 is forced from the patient support 10.

Figure 18:
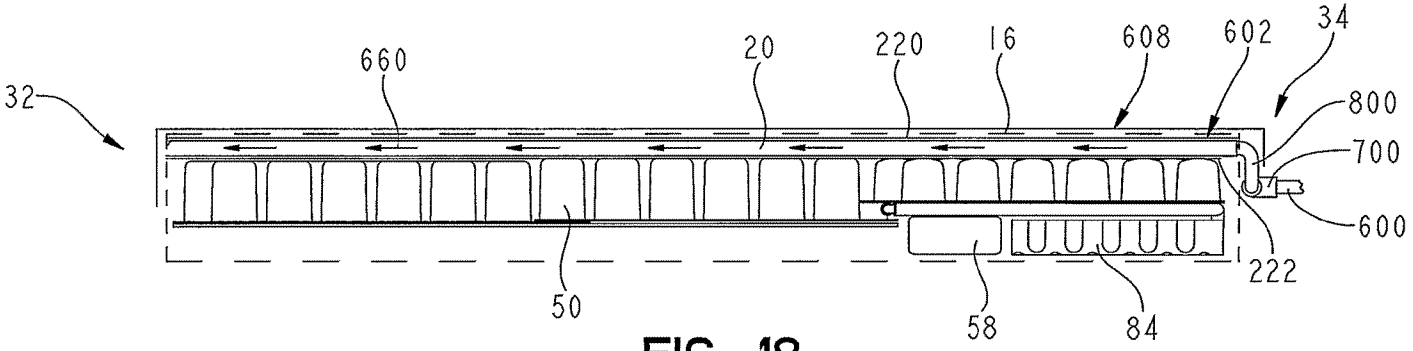
FIG. 18 is a side view of selected components of an alternative embodiment of a patient support.

In FIG. 18, a side view of another embodiment of a patient support 10 is shown with an enclosure 602. Enclosure 602 includes a top surface 608, a fire-resistant material 16 beneath the top surface 608, and a three-dimensional layer 20 beneath the fire-resistant material 16. The three-dimensional layer 20 includes a top membrane layer 220 and a bottom membrane layer 222. The top membrane layer 220 and bottom membrane layer 222 can be impermeable to air and the three-dimensional material 20 can include Spacenet, Tytex, and/or similar material, as disclosed in FIGS. 4 and 9 and corresponding descriptions, for example. One or more inflatable bladders 50 are provided as an additional support layer beneath the bottom membrane layer 222. At the foot end 34 of the patient support 10, a pneumatic box 58 and an additional layer 84, are provided. Layer 84 includes a retractable foam material in the illustrated embodiment.

Figure 19:
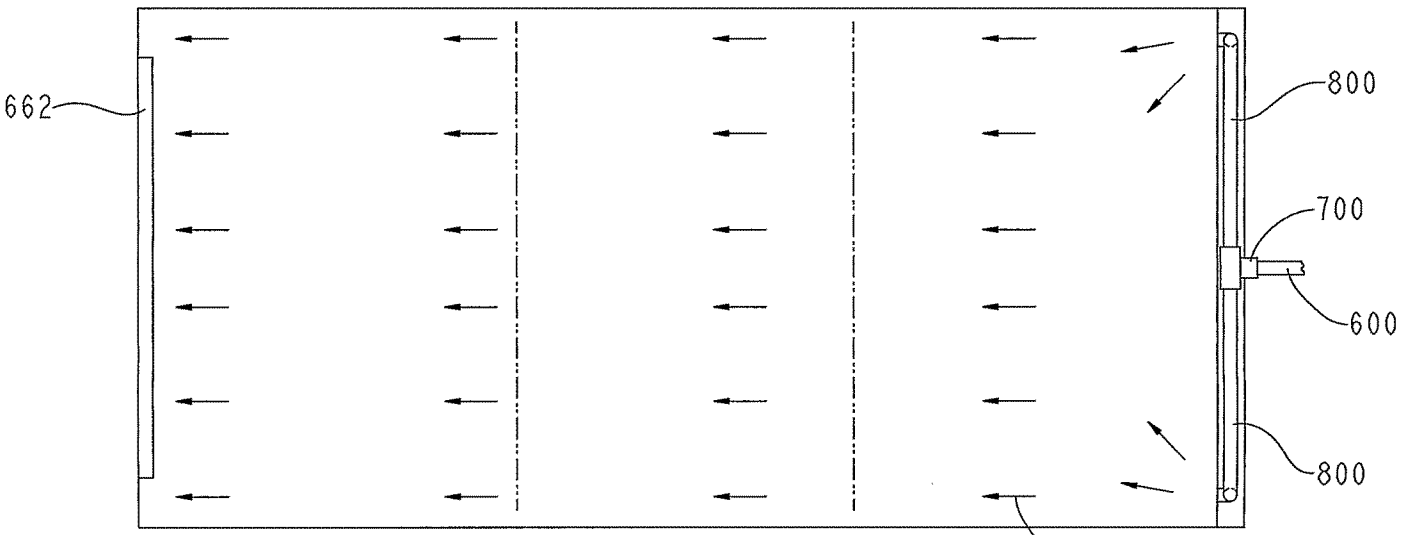
FIG. 19 is a top view showing air flow through the alternative embodiment of the patient support shown in FIG. 18.

As illustrated in FIGS. 18 and 19, air is supplied by an air supply (not shown) through a supply tube 600 located near one end 34 of the patient support 10. The supply tube 600 is coupled to a fitting 700 which also attaches to distributing tubes 800. This arrangement is further shown in FIG. 20 and described below. Air flows through the distributing tubes 800 and into the enclosure 602 in a direction 660 from the one end 34 to the other end 32 of the patient support 10. The air can be released from the enclosure 602 by a vent assembly 662 near the end 32 of the patient support 10. In the illustrated embodiment, air flows from the foot end of the head end of the patient support. In other embodiments, air may flow in the reverse direction or laterally across the patient support.

Figure 20:
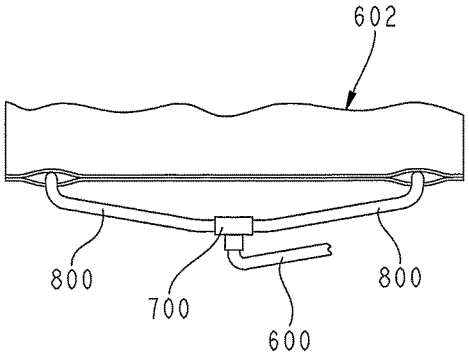
FIG. 20 is a schematic view of a supply tube attaching to an enclosure through a T-fitting.

In FIG. 20, another embodiment for supplying air to the enclosure 602 is shown including a supply tube 600, fitting 700, and distributing tubes 800. Air is received by a supply tube 600 and is transported into distributing tubes 800. The supply tube 600 and distributing tubes 800 are attached by a fitting 700. The fitting 700 can be a T-fitting, as shown in FIG. 20, or any other type of suitable fitting known in the art. Air flows through the distributing tubes 800 and into the enclosure 602.

Figure 21:
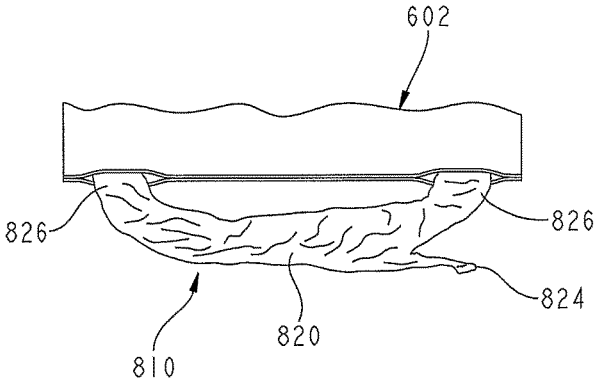
FIG. 21 is a schematic view of a cloth manifold attaching to an enclosure.
Figure 22:
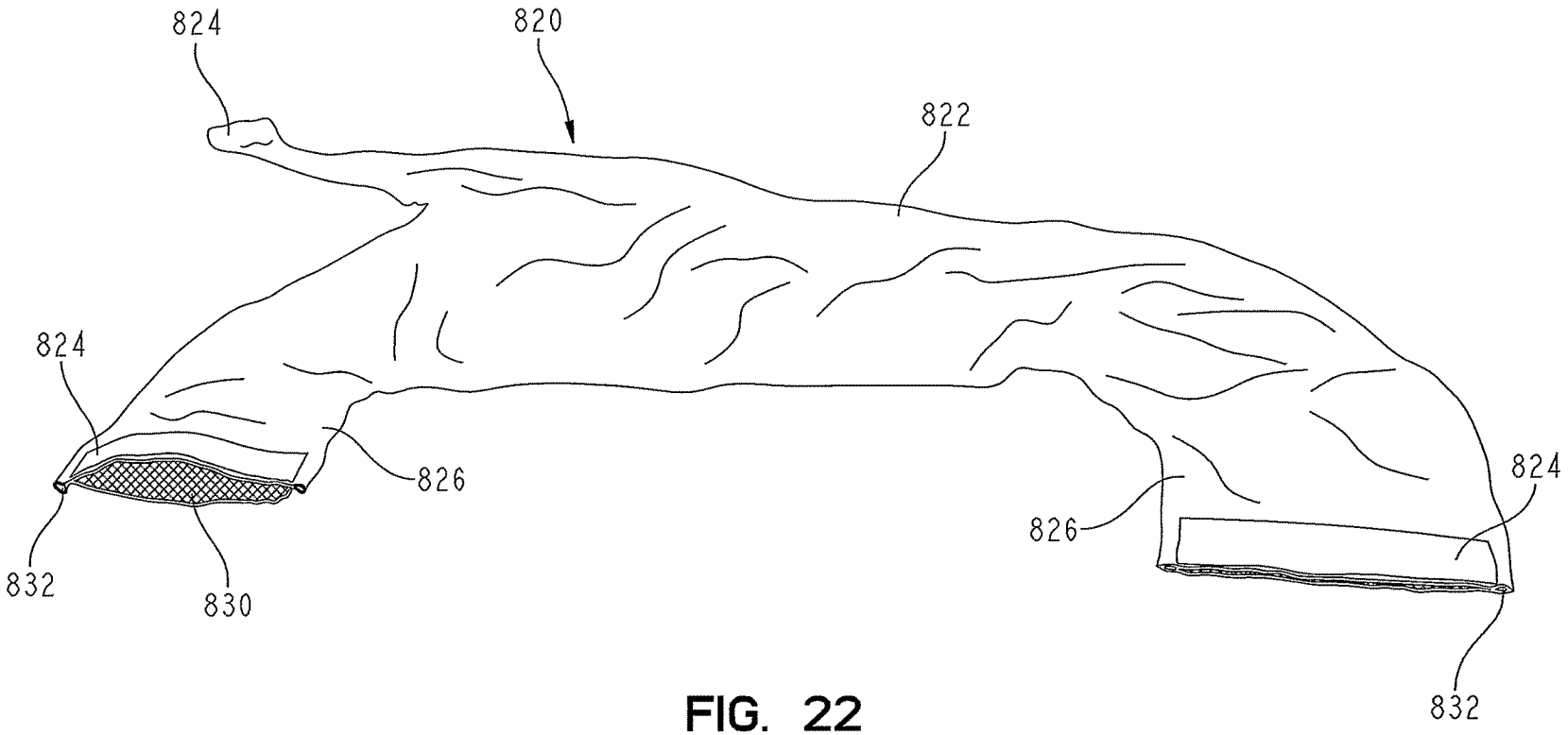
FIG. 22 is a schematic view of various layers of a cloth manifold.

Another embodiment of the supply tube 600, fitting 700, and distributing tubes 800 arrangement is shown in FIGS. 21 and 22 including a cloth manifold arrangement 810. The cloth manifold arrangement 810 includes a cloth manifold 820 made of an outer layer material 822 that can be impermeable to air. The cloth manifold 820 is a soft material that provides additional comfort to the patient and includes a receiving portion 824 and a plurality of distributing portions 826. The receiving portion 824 can attach to a flow tube (not shown) or directly to an air supply (not shown). The distributing portions 826 are coupled to the enclosure 602 by one or more Velcro®-brand strips or similar fasteners 828. The distributing portions 826 may also include hollow receiving apertures 832 used for additional fastening the distributing portions 826 to the enclosure 602. The cloth manifold 820 may include an inner layer 830, as shown in FIG. 22, made from three-dimensional material 20 such as Spacenet, Tytex, and/or similar material as described above. The inner layer 830 may be configured to help prevent the cloth manifold 820 from kinking or collapsing which may cut off or reduce the air supply to the enclosure 602.

The present invention has been described with reference to certain exemplary embodiments, variations, and applications. However, the present invention is defined by the appended claims and therefore should not be limited by the described embodiments, variations, and applications.

The invention claimed is:

1. A patient support comprising:

a cover defining an interior region;

a plurality of bladders located within the interior region;

an enclosure within the interior region, the enclosure forming a unitary volume;

a supply tube to supply air to the unitary volume of the enclosure via a pair of spaced apart apertures located adjacent opposite sides of the enclosure; and a control unit operably coupled to the plurality of bladders and to the supply tube, the control unit comprising an air pump and a switching valve, the control unit selectively configurable to provide air to the plurality of bladders and to the enclosure, wherein the control unit is operable to electrically signal the switching valve to move between a first position in which pressurized air from the air pump is provided to the plurality of bladders and a second position in which vacuum from the air pump is provided to the plurality of bladders, wherein the control unit supplies a first pressure and volume of air to the plurality of bladders and a second volume and pressure of air to the enclosure, wherein the second volume and pressure of air is different than the first pressure and volume of air, wherein the first pressure is greater than the second pressure when the switching valve is in the first position.

2. The patient support of claim 1, comprising at least one distributing portion coupled between the supply tube and the enclosure.

3. The patient support of claim 1, wherein the control unit comprises a software routine executable to control the air pump and switching valve to create the vacuum when the switching valve is in the second position.

4. The patient support of claim 1, wherein the plurality of bladders comprises a plurality of vertical bladders.

5. The patient support of claim 1, wherein the first volume is less than the second volume.

6. A patient support comprising:

a cover defining an interior region;

a plurality of bladders located within the interior region;

an air loss device to direct a volume of air through the interior region, the air loss device forming a unitary volume;

an air supply to supply a first pressure and volume of air to the plurality of bladders and supply a second volume and pressure of air to the air loss device;

a switching valve electrically operable to move between a first position in which pressurized air from the air supply is provided to the plurality of bladders and a second position in which vacuum from the air supply is provided to the plurality of bladders; and a manifold coupled to the air supply and to the unitary volume of the air loss device via a pair of spaced apart apertures located adjacent opposite sides of the air loss device, wherein the first pressure is greater than the second pressure when the switching valve is in the first position.

7. The patient support of claim 6, wherein the manifold comprises a supply portion and a delivery portion, the supply portion receives the volume of air from the air supply and the delivery portion directs the volume of air through the interior region.

8. The patient support of claim 7, wherein the delivery portion is located between a seat section of the patient support and a foot section of the patient support.

9. The patient support of claim 6, further comprising a three dimensional fiber network material located above the plurality of bladders.

10. The patient support of claim 9, wherein the three dimensional fiber network material comprises an air permeable material.

11. The patient support of claim 6, wherein the first volume is less than the second volume.

12. The patient support of claim 6, comprising a strap to hold the patient support in a folded position.

13. The patient support of claim 6, comprising a sensor located within the interior region.

14. The patient support of claim 13, comprising a control board to receive a signal from the sensor, wherein the control board is located in the interior region.

15. The patient support of claim 13, comprising a second layer of the air-permeable three-dimensional material within the enclosure, wherein the second layer comprises a second plurality of dome-shaped projections projecting in an opposite direction from the plurality of dome-shaped projections of the first layer.

16. The patient support of claim 6, comprising a pneumatic device located in the interior region.

17. The patient support of claim 16, wherein the pneumatic device comprises a valve block.

18. The patient support of claim 6, comprising an enclosure positioned above the plurality of bladders, wherein the enclosure is coupled to the air loss device and the patient support further comprises a first layer of an air-permeable three-dimensional material within the enclosure and the first layer comprises a plurality of dome-shaped projections.

19. A patient support comprising:

a cover defining an interior region;

a plurality of bladders located within the interior region;

an enclosure within the interior region, the enclosure forming a unitary volume;

a supply tube to supply air to the unitary volume of the enclosure via a pair of spaced apart apertures located adjacent opposite sides of the enclosure; and a control unit operably coupled to the plurality of bladders and to the supply tube, the control unit comprising an air pump and a switching valve, the control unit selectively configurable to provide air to the plurality of bladders and to the enclosure, wherein the control unit is operable to electrically signal the switching valve to move between a first position in which pressurized air from the air pump is provided to the plurality of bladders and a second position in which vacuum from the air pump is provided to the plurality of bladders, wherein the control unit supplies a first pressure and volume of air to the plurality of bladders and a second volume and pressure of air to the enclosure when the switching valve is in the first position, wherein the first volume is less than the second volume.

20. A patient support comprising:

a cover defining an interior region;

a plurality of bladders located within the interior region;

an air loss device to direct a volume of air through the interior region, the air loss device forming a unitary volume;

an air supply to supply a first pressure and volume of air to the plurality of bladders and supply a second volume and pressure of air to the air loss device;

a switching valve electrically operable to move between a first position in which pressurized air from the air supply is provided to the plurality of bladders and a second position in which vacuum from the air supply is provided to the plurality of bladders; and a manifold coupled to the air supply and to the unitary volume of the air loss device via a pair of spaced apart apertures located adjacent opposite sides of the air loss device, wherein the manifold comprises a supply portion and a delivery portion, the supply portion receives the volume of air from the air supply and the delivery portion directs the volume of air through the interior region.

21. A patient support comprising:

a cover defining an interior region;

a plurality of bladders located within the interior region;

an air loss device to direct a volume of air through the interior region, the air loss device forming a unitary volume;

an air supply to supply a first pressure and volume of air to the plurality of bladders and supply a second volume and pressure of air to the air loss device;

a switching valve electrically operable to move between a first position in which pressurized air from the air supply is provided to the plurality of bladders and a second position in which vacuum from the air supply is provided to the plurality of bladders;

a manifold coupled to the air supply and to the unitary volume of the air loss device via a pair of spaced apart apertures located adjacent opposite sides of the air loss device; and a three dimensional fiber network material located above the plurality of bladders.

22. A patient support comprising:

a cover defining an interior region;

a plurality of bladders located within the interior region;

an air loss device to direct a volume of air through the interior region, the air loss device forming a unitary volume;

an air supply to supply a first pressure and volume of air to the plurality of bladders and supply a second volume and pressure of air to the air loss device;

a switching valve electrically operable to move between a first position in which pressurized air from the air supply is provided to the plurality of bladders and a second position in which vacuum from the air supply is provided to the plurality of bladders; and a manifold coupled to the air supply and to the unitary volume of the air loss device via a pair of spaced apart apertures located adjacent opposite sides of the air loss device, wherein the first volume is less than the second volume when the switching valve is in the first position.

23. A patient support comprising:

a cover defining an interior region;

a plurality of bladders located within the interior region;

an air loss device to direct a volume of air through the interior region, the air loss device forming a unitary volume;

an air supply to supply a first pressure and volume of air to the plurality of bladders and supply a second volume and pressure of air to the air loss device;

a switching valve electrically operable to move between a first position in which pressurized air from the air supply is provided to the plurality of bladders and a second position in which vacuum from the air supply is provided to the plurality of bladders;

a manifold coupled to the air supply and to the unitary volume of the air loss device via a pair of spaced apart apertures located adjacent opposite sides of the air loss device; and an enclosure positioned above the plurality of bladders, wherein the enclosure is coupled to the air loss device and the patient support further comprises a first layer of an air-permeable three-dimensional material within the enclosure and the first layer comprises a plurality of dome-shaped projections.

24. A patient support comprising:

a cover defining an interior region;

a plurality of bladders located within the interior region;

an air loss device to direct a volume of air through the interior region, the air loss device forming a unitary volume;

an air supply to supply a first pressure and volume of air to the plurality of bladders and supply a second volume and pressure of air to the air loss device;

a switching valve electrically operable to move between a first position in which pressurized air from the air supply is provided to the plurality of bladders and a second position in which vacuum from the air supply is provided to the plurality of bladders; and a manifold coupled to the air supply and to the unitary volume of the air loss device via a pair of spaced apart apertures located adjacent opposite sides of the air loss device, a second layer of the air-permeable three-dimensional material within the enclosure, wherein the second layer comprises a second plurality of dome-shaped projections projecting in an opposite direction from the plurality of dome-shaped projections of the first layer.

* * * * *